US007971528B2

(12) United States Patent
Kagawa

(10) Patent No.: US 7,971,528 B2
(45) Date of Patent: Jul. 5, 2011

(54) USED-MASTER SECURITY SYSTEM FOR A PRINTING APPARATUS

(75) Inventor: Hideyuki Kagawa, Miyagi (JP)

(73) Assignee: Tohoku Ricoh Co., Ltd., Shibata-gun (JP)

( * ) Notice: Subject to any disclaimer, the term of this patent is extended or adjusted under 35 U.S.C. 154(b) by 361 days.

(21) Appl. No.: 10/985,059

(22) Filed: Nov. 10, 2004

(65) Prior Publication Data

US 2005/0156750 A1 Jul. 21, 2005

(30) Foreign Application Priority Data

Nov. 18, 2003 (JP) ..... 2003-388119

(51) Int. Cl.
*B41L 13/00* (2006.01)

(52) U.S. Cl. ..... 101/116; 101/477; 312/208.3

(58) Field of Classification Search ..... None
See application file for complete search history.

(56) References Cited

U.S. PATENT DOCUMENTS

| | | | | |
|---|---|---|---|---|
| 4,131,173 | A * | 12/1978 | Boersma | 70/160 |
| 5,165,262 | A * | 11/1992 | Brem et al. | 70/57 |
| 5,417,488 | A * | 5/1995 | Horton | 312/208.3 |
| 5,782,687 | A * | 7/1998 | Sniegocki | 361/690 |
| 5,931,032 | A * | 8/1999 | Gregory | 70/129 |
| 6,067,901 | A * | 5/2000 | Takahashi | 101/114 |
| 6,170,304 | B1 * | 1/2001 | Ohta | 70/58 |
| 6,345,576 | B2 * | 2/2002 | Furutsuka | 101/477 |
| 6,634,287 | B2 * | 10/2003 | Mizutani et al. | 101/114 |

FOREIGN PATENT DOCUMENTS

| | | |
|---|---|---|
| JP | 59-198185 | 11/1984 |
| JP | 61-31763 | 2/1986 |
| JP | 63-74679 | 4/1988 |
| JP | 8-183238 | 7/1996 |
| JP | 9-71029 | 3/1997 |
| JP | 10-226147 | 8/1998 |
| JP | 2002-86882 | 3/2002 |
| JP | 2005342896 A * | 12/2005 |

* cited by examiner

*Primary Examiner* — Jill E Culler

(74) *Attorney, Agent, or Firm* — Oblon, Spivak, McClelland, Maier & Neustadt, L.L.P.

(57) ABSTRACT

There is provided a used-master security system for a printing apparatus that can prohibit the removal of used masters for any type of master and to safely secure used masters by prohibiting the removal of used masters; a used-master security method for a printing apparatus in which the used-master security system of the printing apparatus is used; and a printing apparatus capable of prohibiting the removal of used masters with the used-master security system for a printing apparatus, and having a used-master storage device for storing used-masters provided to the printing apparatus main body and a used-master security device that is capable of prohibiting the removal of used masters inside the used-master storage device.

22 Claims, 14 Drawing Sheets

USED-MASTER SECURITY SYSTEM FOR A PRINTING APPARATUS

BACKGROUND OF THE INVENTION

1. Field of the Invention

The present invention relates to a used-master security system for a printing apparatus that can prohibit the removal of a used master and protect the master, a used-master security method for a printing apparatus in which the used-master security system for a printing apparatus is used, and a printing apparatus in which the used-master security system for a printing apparatus can prohibit the removal of a used master.

2. Description of the Related Art

A printing apparatus is conventionally used for printing several sheets and for other purposes. Known types of printing apparatuses that wind a so-called master on a plate cylinder to carry out printing include examples cited in Japanese Patent Application Laid-open Nos. S59-198185 (Prior Art 1), S63-74679 (Prior Art 2), H8-183238 (Prior Art 3), H9-71029 (Prior Art 4), and 2002-86882 (Prior Art 5). This type of printing apparatus has a drawback in that the information recorded on the master may be revealed. In other words, if the master is left wound on the plate cylinder when printing is completed, another person may thereafter print using this master, so it is possible that the information recorded on the master may be revealed. There is, therefore, a drawback from the aspect of managing sensitive information, particularly in public agencies, schools, businesses, and other environments in which many people use such a printing apparatus.

In view of the above, printing apparatuses that prevent other people from printing using the master after printing is completed have been proposed in the disclosures of prior arts 1 to 4 noted above. However, the arts disclosed in these instances of prior art, while preventing other people from performing printing by using the master after printing is completed, and preventing revelation of the information recorded on the master by further printing, still allow the master after printing is completed to be stored inside the printing apparatus, so there is still a drawback from the aspect of managing sensitive information in that the used master can be freely removed from the printing apparatus.

In view of the above, the prior art 5 noted above proposes an art that applies heat and shrinks the master so that the information recorded on the used master cannot be read. According to this art, there is no drawback from the aspect of managing sensitive information even if the master after being shrunk through the application of heat can be freely removed from the printing apparatus. In the art disclosed in prior art 5, however, shrinking does not occur if the master is not composed of a heat shrinkable material, so there is a drawback in that the types of master that can be used are limited. There are also various types of heat shrinkable materials, there is disparity in the temperature that causes shrinkage, the heat shrinkable material itself and materials resulting from laminating other materials to the heat shrinkable material have a thermal capacity, and the thermal capacity differs according to the material, so when the heating temperature is set high so as to reliably shrink the master, there is a danger that the master will be excessively heated when using a material with a low heat-shrinking temperature or when using a material with a small thermal capacity.

Technologies relating to the present invention are (also) disclosed in, e.g., Japanese Patent Application Laid-open No. H10-226147.

SUMMARY OF THE INVENTION

An object of the present invention is to provide a used-master security system of a printing apparatus for safely securing all types of used masters by preventing the removal of the used master; a method of securing a used master of a printing apparatus that uses the used-master security system of the printing apparatus; and a printing apparatus that can prevent the removal of the used master by the used-master security system of the printing apparatus.

In accordance with the present invention, a used-master security system for a printing apparatus comprises a used-master storage device provided to a printing apparatus main body and used for storing a used master, and a used-master security device that can prohibit the removal of a used-master inside the master storage device.

In accordance with the present invention, a used-master security method for a printing apparatus is capable of prohibiting the removal of used masters from the used-master storage device using the used-master security system for a printing apparatus. The used-master security system is a used-master security system for a printing apparatus. The printing apparatus comprises a used-master storage device provided to a printing apparatus main body and used for storing a used master, and a used-master security device that can prohibit the removal of a used-master inside the master storage device.

In accordance with the present invention, a printing apparatus comprises at least the used-master storage device and at least a portion of the used-master security device provided to the used-master security system for a printing apparatus. The apparatus is capable of prohibiting the removal of used masters inside the used-master storage device. The used-master security system is a used-master security system for a printing apparatus. The printing apparatus comprises a used-master storage device provided to a printing apparatus main body and used for storing a used master, and a used-master security device that can prohibit the removal of a used-master inside the master storage device.

BRIEF DESCRIPTION OF THE DRAWINGS

The above and other objects, features, and advantages of the present invention will become more apparent from the following detail description taken with the accompanying drawings which.

DESCRIPTION OF THE PREFERRED EMBODIMENTS

The present invention is described in detail below with reference to the diagrams.

Figure 1:
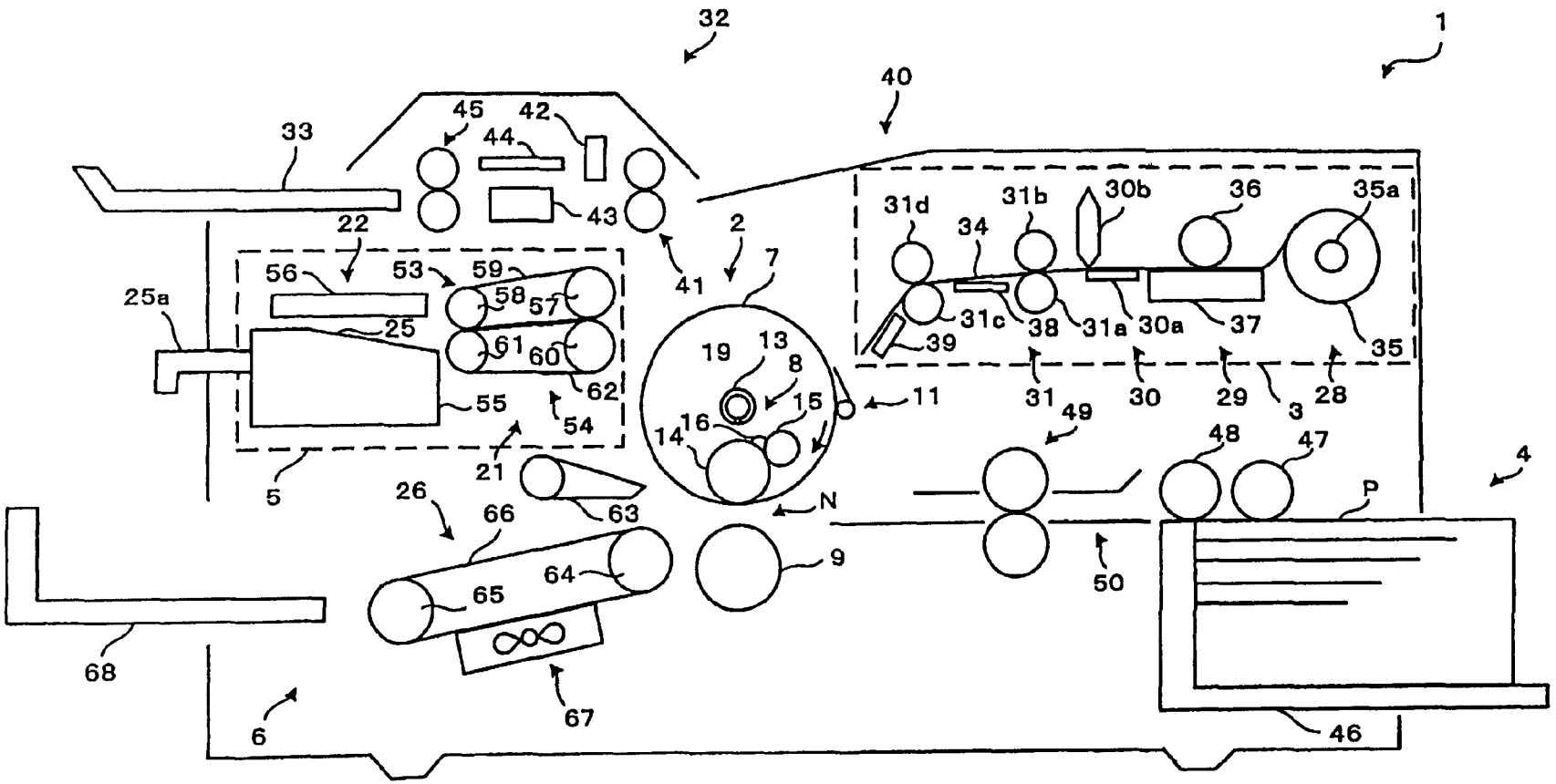
FIG. 1 is a front view showing the general configuration of the printing apparatus and the used-master security system of the printing apparatus to which the present invention has been applied.

Shown in FIG. 1 is the general configuration of a screen-printing apparatus with thermal digital plates to which the present invention has been applied. The screen-printing apparatus 1 has the printing unit 2 shown in FIG. 1; a plate-making apparatus 3, which is a plate writing apparatus that serves as a plate-making unit; a source document reader 32 as a source document reading unit; a paper supply apparatus 4 as a paper supply unit; a plate discharge apparatus 5 as a plate-discharge unit; a paper discharge unit 6; the control panel 69 shown in FIG. 6; a control device 24 as the control unit shown in FIG. 7; and a lock display output device 119 as the lock state output device shown in FIGS. 7 and 8.

Figure 7:
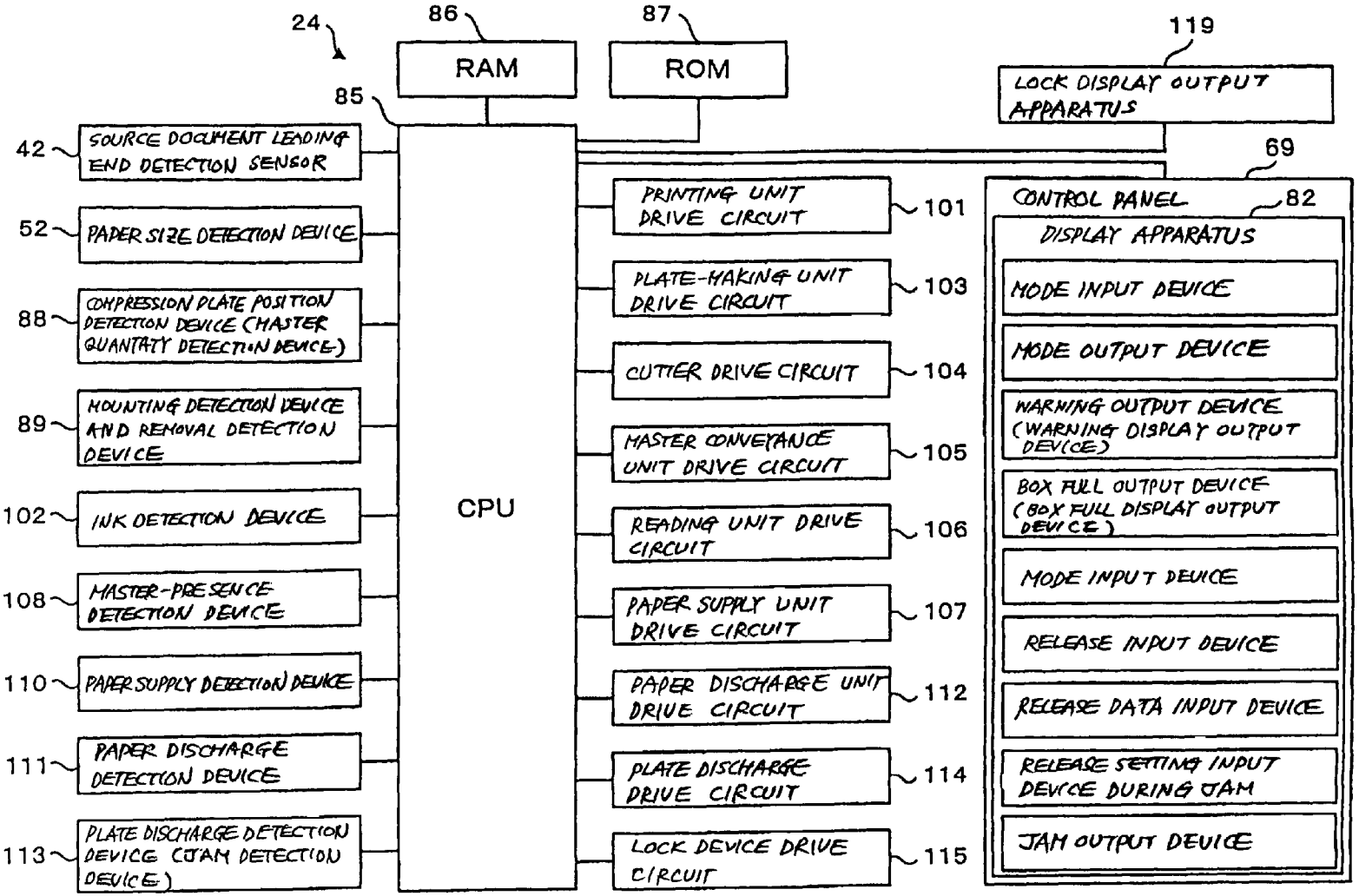
FIG. 7 is a block diagram showing the control device provided to the printing apparatus shown in FIG. 1.

The printing unit 2 has a plate cylinder 7, an ink supply device 8, a press roller 9, and the master-presence detection device 108 shown in FIG. 7.

The plate cylinder 7 is formed in a cylindrical shape from an etched stainless steel thin plate or a nickel electroformed thin plate. The plate cylinder 7 has a plurality of holes with a spacing of 0.25 to 1.0 mm and a diameter of 0.15 to 0.5 mm formed on the external peripheral surface, and is rotatably driven by a main motor as a drive device (not shown). The main motor is controlled by a control device 24 and is driven by the printing unit drive circuit 101 shown in FIG. 7.

About one to three layers of a mesh screen (not shown) woven with polyester or stainless steel thin filaments or the like to a mesh number of about #100 to 400 are wound on the external peripheral surface of the plate cylinder 7. A clamper 11 as a clamping device for clamping the edge of the master 34 is disposed on the external peripheral surface of the plate cylinder 7. The plate cylinder 7 is fixed by a flange (not shown) at both ends thereof, and freely rotates about the center of an ink supply pipe 13 (described below) positioned at the center of the flange.

The ink supply device 8 is disposed inside the plate cylinder 7. The ink supply device 8 has an ink supply pipe 13, an ink roller 14, a doctor roller 15, the ink detection device 102 shown in FIG. 7, and an ink supply drive device (not shown).

The ink supply pipe 13 doubles as a drum axle that serves as the support axle for the plate cylinder 7. The ink supply pipe 13 is rotatably supported at one end by the side plate of the case (not shown) of the screen-printing apparatus 1, and numerous small holes are formed on the surface thereof to feed ink to the interior of the plate cylinder 7.

The ink roller 14 and the doctor roller 15 are disposed below the ink supply pipe 13. The ink roller 14 is rotatably supported by the side plate of the plate cylinder 7, the external peripheral surface thereof is placed in contact with the internal peripheral surface of the plate cylinder 7, and the ink supply drive device is driven to feed ink supplied by the ink supply pipe 13 to the plate cylinder. The doctor roller 15 is rotatably disposed in the vicinity of the ink roller 14. The doctor roller 15 is disposed so that a slight gap is formed between the external peripheral surface thereof and the external peripheral surface of the ink roller 14; and a cuneiform ink reservoir 16 is formed in close contact with external peripheral surface of the ink roller 14.

Ink fed to the ink reservoir 16 by the ink supply pipe 13 is provided in a uniform layer by being supplied through the gap between the ink roller 14 and the doctor roller 15, and is fed to the external peripheral surface of the ink roller 14. The ink detection device 102 detects the amount of ink in the ink reservoir 16 and sends a signal to the control device 24 indicating when the amount of ink is low; and the control device 24 drives the ink supply drive device to feed ink from the supply pipe 13 until the signal from the ink detection device 102 is no longer received.

A press roller 9 is disposed below the plate cylinder 7. The press roller 9 is rotatably supported on a shaft (not shown) that is integrally formed with the press roller 9. The shaft is provided to a sliding device (not shown) that is slidably supported on the side plate of the case (not shown) of the screen-printing apparatus 1, and is fixed to main body side of the sliding device. The press roller 9 is therefore slidably and rotatably supported by the sliding device.

The press roller 9 presses to the plate cylinder 7 the printing paper P fed from the paper supply apparatus 4, and forms a print image on the printing paper P. The press roller 9, which is slidably supported by the sliding device, is configured so that the external peripheral surface thereof makes contact with and separates from the external peripheral surface of the plate cylinder 7 during formation of a print image, and is configured so as to rotate together with the movement of the printing paper P that is pressed to the plate cylinder 7 and integrally moves with the plate cylinder 7.

The master-presence detection device 108 detects the presence of a master 34 on the plate cylinder 7 and sends to the control device 24 a signal indicating the presence of a master 34 on the plate cylinder 7.

The plate-making apparatus 3 is disposed above and to the right of the printing unit 2. The plate-making apparatus 3 has a master-storage device 28, a plate-making device 29, a cutting device 30, and a conveyance device 31 as a master-conveyance device.

The master-storage device 28 has a master-storage member (not shown) fixed to the side plate of the case (not shown) of plate-making device 3. The master-storage member has a U-shaped groove (not shown), and the core portion 35*a* of a master roll 35 on which the master 34 is wound in the form of a roll is rotatably supported in this groove.

The plate-making device 29 is disposed to the left of the master-storage device 28 in FIG. 1. The plate-making device 29 has a platen roller 36, a thermal head 37, and a stepping motor (not shown).

The platen roller 36 is rotatably supported by the side plate of the case (not shown) of the plate-making device 3, rotated and driven by the stepping motor, pressed to the thermal head 37 as the master 34 is drawn from the master roll 35, and conveyed downstream. The stepping motor is controlled by the control-device 24 and driven by the plate-making unit drive circuit 103 shown in FIG. 7.

The thermal head 37 has a plurality of heating elements. The thermal head 37 is attached to the side plate of the case (not shown) of the screen-printing apparatus 1, urged by an urging device (not shown), and pressed to the platen roller 36. The thermal head 37 uses heat to melt holes in the master 34 drawn from the master roll 35 by the platen roller 36 and to complete the plate for the master 34. The heating action of the thermal head 37 is driven by the plate-making drive circuit 103, which is controlled by the control device 24.

The cutting device 30 is disposed on the downstream side in the master conveyance direction of the plate-making device 29. The cutting device 30 has a stationary blade 30*a* attached to the case, and a moving blade 30*b* that rotatably moves with respect to the stationary blade 30*a*. The rotation of the movable blade 30*b* is controlled by the control device 24 and is driven by the cutter driving circuit 104 shown in FIG. 7.

The conveyance device 31 is disposed on the downstream side in the master conveyance direction of the cutting device 30. The conveyance device 31 has a drive roller 31*a* as a conveyance drive roller that is rotatably driven by a stepping motor as a drive device (not shown), a drive roller 31*c* as a delivery drive roller, and a driven roller 31*b* as a conveyance driven roller and a driven roller 31*d* as a conveyance delivery roller that rotate in conjunction with the drive rollers 31*a* and 31*c*, respectively.

The conveyance device 31 has a guide plate 38 that is disposed between the pair of rollers comprising the drive roller 31*a* and driven roller 31*b* and the pair of rollers comprising the drive roller 31*c* and driven roller 31*d*, and that aids in the conveyance of the master 34; and a guide plate 39 as a master guide plate disposed on the downstream side in the master conveyance direction of the pair of rollers comprising the drive roller 31*c* and driven roller 31*d*, for guiding the master 34 toward the clamper 11.

The drive rollers 31*a* and 31*c*, and the driven rollers 31*b* and 31*d* are all rotatably supported by the side plate of the case (not shown) of the plate-making apparatus 3. The guide plates 38 and 39 are fixedly supported by the same side plate.

A pulley and belt (not shown) for obtaining drive action from the above-described stepping motor are linked to one side of the drive roller 31*c*. Gears or other components may be used as devices for obtaining drive action from the stepping motor. The drive device for driving the drive rollers 31*a* and 31*c* may be an electromagnetic clutch.

The drive roller 31*c* is configured to rotate in conjunction with the master 34 as the master 34 is drawn out by the plate cylinder 7 when wound on the plate cylinder 7. Specifically, the bearings thereof are composed of ball bearings with low rotational friction and are configured so that the nip pressure with the driven roller 31*d* is set to an appropriate level to allow for joint rotation. The stepping motor is controlled by the control device 24, and is driven by the master-conveyance drive circuit 105 shown in FIG. 7.

The source document reader 32 disposed above and to the left of the printing unit 2. The source document reader 32 has a source document-setting unit 40 that is disposed above the screen-printing apparatus 1 and is used for setting a source document, a pair of source document conveyance rollers 41 for delivering the set source document to the source document-setting unit 40, a source document front edge detection sensor 42 for detecting the front edge of the source document delivered by the pair of source document conveyance rollers 41, a close contact image sensor, that is, CIS 43, for reading a source document image through close contact with the source document, a white reference plate 44 as a pressure plate for bringing the source document into close contact with the CIS 43, a pair of source document conveyance rollers 45 for discharging the source document read by the CIS 43 to the exterior of screen-printing apparatus 1 main body, a source document paper discharge tray 33 disposed outside of the screen-printing apparatus 1 main body and used for accumulating source documents thus read and conveyed by the pair of source document conveyance rollers 45, and a stepping motor as a drive device (not shown) for driving the pair of source document conveyance rollers 41 and the pair of source document conveyance rollers 45.

The source document-setting unit 40 has a side fence (not shown). The source document front edge detection sensor 42 sends a signal to the control device 24 when the front edge of the source document has been detected. The driving of the pair of source document conveyance rollers 41 and the pair of source document conveyance rollers 45 by the stepping motor and the reading of the source document by the CIS 43 are controlled by the reading unit drive circuit 106 shown in FIG. 7, which is controlled by the control device 24.

The paper supply apparatus 4 is disposed below the plate-making apparatus 3. The paper supply apparatus 4 has a paper supply tray 46, a paper supply roller 47, a separation roller 48 as a separating device, a pair of resist rollers 49, a guide plate 50, a drive device (not shown) for driving the paper supply tray 46, a paper supply roller 47, a separation roller 48, a pair of resist rollers 49, and the paper detection device 110 shown in FIG. 7.

The paper supply tray 46 is loaded with printing paper P on the upper surface thereof. The paper supply tray 46 operates in coordination with the changes in the supply of the printing paper P and is moved up and down by the drive device (not shown). For this reason, the paper supply tray 46 is supported by the case of the screen-printing apparatus 1 in a manner that allows free vertical movement. The side fence (not shown) and the paper size detection device 52 shown in FIG. 7 for detecting the width of the printing paper P in association with the movement of the side fence, and thereby detecting the size of the printing paper P, are provided to the paper supply tray 46.

The paper supply roller 47 and the separation roller 48 are disposed above the paper supply tray 46. The paper supply roller 47 and the separation roller 48 move vertically so as to come into contact with the printing paper P in the highest position on the paper supply tray 46. The paper supply roller 47 delivers printing paper P to the highest position on the paper supply tray 46. The separation roller 48 is configured to separate and convey a single sheet from the highest position when a plurality of sheets of printing paper P are drawn and sent from the top of the paper supply tray 46 by the paper supply roller 47.

The pair of resist rollers 49 is disposed on the downstream side of the separation roller 48 in the conveyance direction of the printing paper P. The pair of resist rollers 49 draws in the printing paper P fed by the separation roller 48, synchronizes with the sliding movement of rotation of the plate cylinder 7 and the press roller 9, and feeds printing paper P to the nip unit N located between the external peripheral surface of the plate cylinder 7 and the press roller 9.

The guide plate 50 extends in the conveyance direction of the printing paper P on both sides of the pair of resist rollers 49 in the conveyance direction of the printing paper P, and is fixed to the side plate of the case (not shown) of the screen-printing apparatus 1. The guide plate 50 guides the printing paper P fed by the separation roller 48 toward the pair of resist rollers 49 and guides the printing paper P sent from the pair of resist rollers 49 toward the nip unit N. The paper detection device 110 shown in FIG. 7 is disposed on the downstream side of the pair of resist rollers 49 in the conveyance direction of the printing paper P.

The paper size detection device 52 detects the size of the paper and sends a signal indicating the size of the paper to the control device 24. The paper detection device 110 detects the printing paper P sent from the pair of resist rollers 49 toward the nip unit N, and sends to the control device 24 a signal indicating that the printing paper P has been detected. The driving action of the drive device for driving the paper supply tray 46, paper supply roller 47, separation roller 48, and pair of resist rollers 49 is controlled by the paper supply unit drive circuit 107 shown in FIG. 7, which is controlled by the control device 24.

The paper discharge unit 6 is disposed below and to the left of the plate cylinder 7. The paper discharge unit 6 has a removal pawl 63, a paper conveyance apparatus 26, a paper discharge tray 68, the paper discharge detection device 111 shown in FIG. 7, and a sliding device (not shown).

The removal pawl 63 removes the printing paper P to which ink has been transferred from the external peripheral surface of the plate cylinder 7. The removal pawl 63 is supported by a rotatable shaft (not shown) that is supported by the side plate of the case (not shown) of the screen-printing apparatus 1, and the leading end thereof is disposed in a manner that allows contact and separation with respect to the external peripheral surface of the plate cylinder 7. The removal pawl 63 is caused to slide by a sliding device, and the sliding action thereof is synchronized with the rotation of the plate cylinder 7 so that the clamper 11 and other components disposed on the external peripheral surface of the plate cylinder 7 do not interfere with the leading end thereof.

The paper conveyance apparatus 26 has a driven roller 64, a drive roller 65, a rubber belt 66, a suction fan 67, and a drive device (not shown).

The driven roller 64 and drive roller 65 are rotatably supported by the side plate of the case. The rubber belt 66 has a plurality of apertures in the surface thereof, and is suspended across the driven roller 64 and drive roller 65. The suction fan 67 is disposed below the rubber belt 66 between the driven roller 64 and drive roller 65.

The drive roller 65 is rotatably driven by the drive device, and the rotational force is transmitted to the driven roller 64 by way of the rubber belt 66. The rotation of the suction fan 67 generates a downward airflow in FIG. 1, and attracts to the surface of the rubber belt 66 the printing paper P on which a printing image is formed. The paper discharge detection device ill shown in FIG. 7 is disposed on the downstream side of the paper conveyance apparatus 26 in the paper conveyance direction.

The paper P on which a printed image is formed is conveyed by the rubber belt 66 rotatably moved by the drive roller 65, with the paper held to the conveyor belt 66 by the suctioning action of suction fan 67.

The paper discharge tray 68 is disposed on the downstream side of the drive roller 65 in the conveyance direction of the printing paper P. The paper discharge tray 68 is attached to the case (not shown) of the screen-printing apparatus 1 in a detachable manner. The paper discharge tray 68 accumulates the printing paper P on which the printed images are formed.

The paper detection device 110 detects the printing paper P sent from the paper conveyance apparatus 26 toward the paper discharge tray 68, and sends a signal to the control device 24 indicating that the printing paper P has been detected. The driving action of the driving device provided with the paper conveyance apparatus 26 is controlled by the paper discharge unit drive circuit 112 shown in FIG. 7. The circuit is controlled by the control device 24.

The plate discharge apparatus 5 is disposed to the left of the printing unit 2. The plate discharge apparatus 5 has a master removal mechanism 21, a plate discharge storage unit 22, and the plate discharge detection device 113 shown only in FIG. 7.

The plate discharge detection device 113 is disposed between the master removal mechanism 21 and the plate discharge storage unit 22. The device detects the used master 34 conveyed from the master removal mechanism 21 toward the plate discharge storage unit 22, and sends a signal to the control device 24 indicating that the master 34 has been detected.

The master removal mechanism 21 is a mechanism for removing the master 34 wound on the external peripheral surface of the plate cylinder 7. The mechanism has an upper plate discharge member 53, a lower plate discharge member 54, a movement device (not shown) for causing the entire master removal mechanism 21 to move, and a drive device (not shown) for driving the upper plate discharge member 53 and lower plate discharge member 54.

The upper plate discharge member 53 has a drive roller 57, a driven roller 58, and a rubber belt 59 as a plate discharge belt suspended between the drive roller 57 and driven roller 58. The lower plate discharge member 54 has a drive roller 60, a driven roller 61, and a rubber belt 62 as a plate discharge belt suspended between the drive roller 60 and driven roller 61. The drive roller 57 is rotatably driven by the drive device. The drive roller 60 is linked to the drive roller 57 by a gear (not shown), and is rotatably driven via the gear by the driving device. The entire master removal mechanism 21 can be moved by the movement device in the direction to and from the plate cylinder 7.

When the master 34 is removed from the plate cylinder 7, the movement device causes the rubber belts 59 and 62 to move the master removal mechanism 21 to the contact position with the master 34 wound on the plate cylinder 7, and the drive device rotatably drives the rubber belts 59 and 62 in that position by causing the drive rollers 57 and 60 to rotate.

The master 34 wound on the external peripheral surface of the plate cylinder 7 is thereby grasped and pulled away by the rubber belts 59 and 62 that form a pair above and below. When the plate cylinder 7 is rotatably driven in this condition, the master 34 is removed from the external peripheral surface of the plate cylinder 7. The used master 34 that was removed from the external peripheral surface of the plate cylinder 7 is delivered to the plate discharge storage unit 22 by the rotating action of the rubber belts 59 and 62.

When such a plate discharge operation has been carried out and a used master 34 is not detected by the plate discharge detection device 113 for a predetermined length of time thereafter, the control device 24 determines that the used master 34 has jammed. The plate discharge detection device 113 serves as a jam detection device for detecting when the used master 34 has jammed in the plate discharge apparatus 5.

Figure 2:
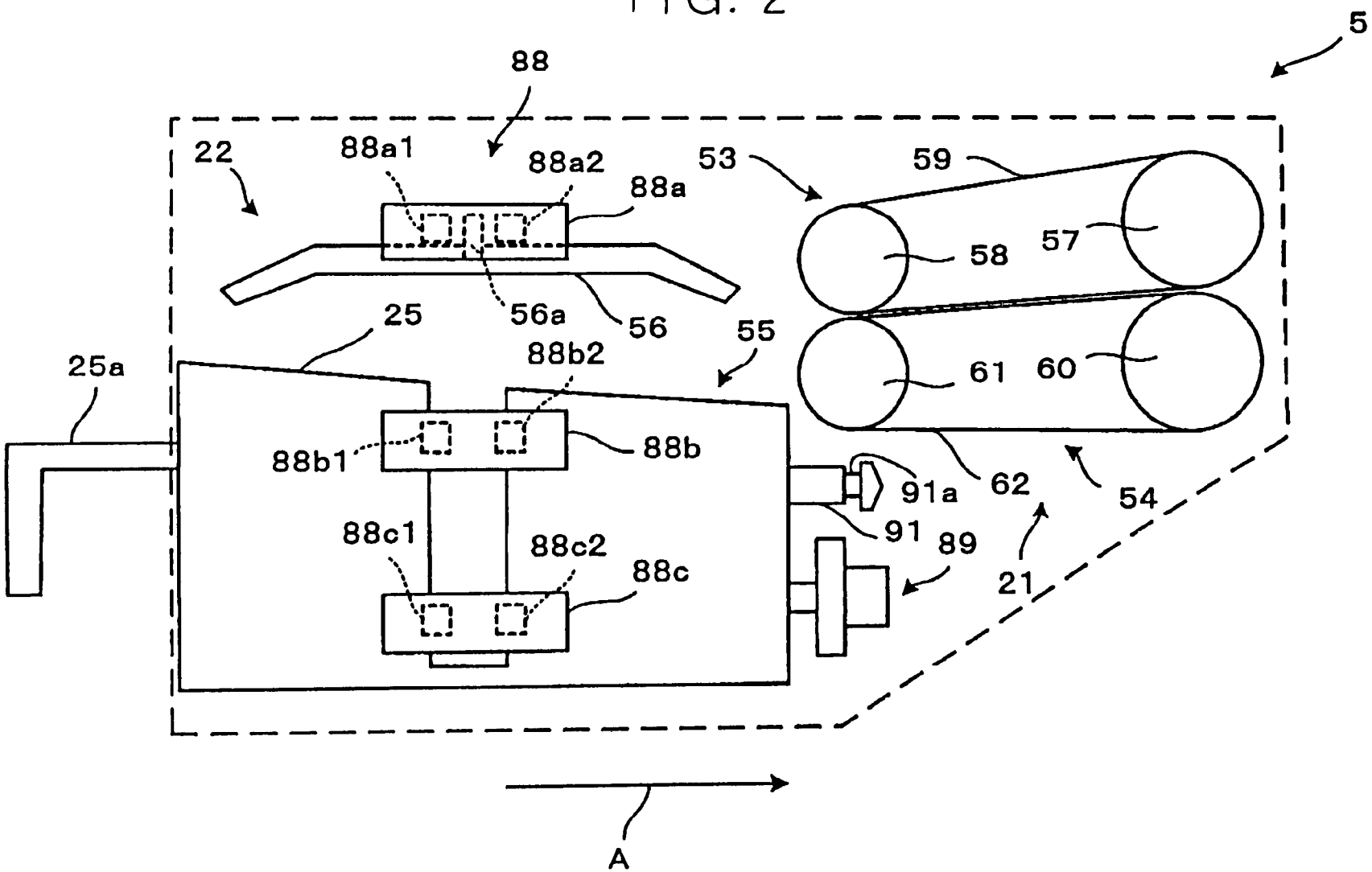
FIG. 2 is a front view of the plate discharge apparatus mounted in the printing apparatus shown in FIG. 1.
Figure 5:
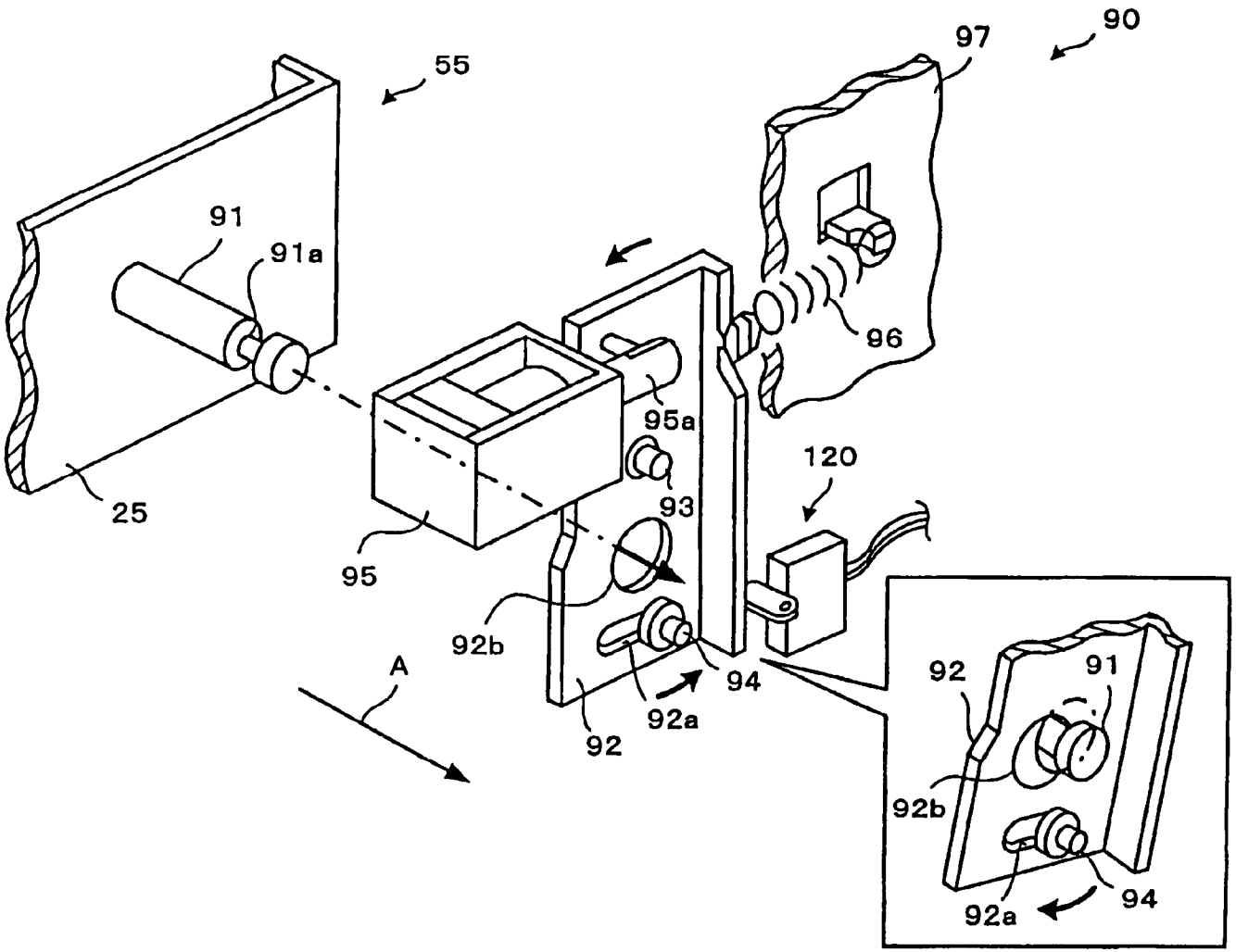
FIG. 5 is a perspective view showing the lock device provided to the plate discharge apparatus shown in FIG. 2.

The plate discharge storage unit 22 stores used masters 34 that have been removed from the plate cylinder 7 by the master removal mechanism 21, and has a plate discharge box 55, which is a plate discharge-storage box that serves as a used-master storage device for storing used masters 34, a compression plate 56 for compressing used masters 34 stored in the plate discharge box 55, a compression plate position detection device 88 as the master quantity detection device shown in FIGS. 2 and 7, a mount detection device 89, which is device for detecting the presence of the plate discharge box shown in FIG. 2, a lock mechanism 90 as the lock device shown in FIG. 5, and a drive device (not shown) for driving the compression plate 56. The plate discharge storage unit 22 has a compression device for compressing the used masters 34.

The plate discharge box 55 has a main body 25 in the form of an open top box for storing used masters 34 fed by the rubber belts 59 and 62, and a knob 25*a* that protrudes from the main body 25 with a portion thereof exposed on the exterior of the main body of the screen-printing apparatus 1. The plate discharge box 55 is detachable from the main body of the screen-printing apparatus 1 so as to be removed away from the main body of the screen-printing apparatus 1 when the space therein has become filled with used masters 34 or in other circumstances. The knob 25*a* is a component that the operator grasps when mounting or detaching the plate discharge box 55 with respect to the main body of the screen-printing apparatus 1.

The compression plate 56 is driven by the drive device so as to slide in a vertical direction, and is configured to reciprocate between the external and internal portions of the main body 25 of the plate discharge box 55 mounted on the main body of the screen-printing apparatus 1. The compression plate 56 ordinarily occupies a standby position as a home position (the highest position) above the main body 25 of the plate discharge box 55 mounted on the main body of the screen-printing apparatus 1, but the used masters 34 conveyed by the rubber belts 59 and 62 are stored in the main body 25 and the compression plate thereafter moves in a downward direction toward the lowest position, which is the lower limit of the moveable range thereof, and compresses the used master 34 inside the main body 25. The compression plate 56 then compresses the masters for a predetermined length of time, and thereafter moves upward to return to the standby position.

The driving action of the movement device provided to the master removal mechanism 21, the driving action of the driving device provided to the master removal mechanism 21, and the driving action of the driving device of the compression plate 56 provided to the plate discharge storage unit 22 are controlled by the plate discharge drive circuit 114 shown in FIG. 7, which is controlled by the control device 24.

The compression plate position detection device 88, as shown in FIG. 2, has transmission sensors 88*a*, 88*b*, and 88*c* as three detection devices disposed in the vertical direction. The transmission sensors 88*a*, 88*b*, and 88*c* have light emitting diodes 88*a*1, 88*b*1, and 88*c*1, respectively, and photodetectors 88*a*2, 88*b*2, and 88*c*2 for detecting light from the light emitting diodes 88*a*1, 88*b*1, and 88*c*1, respectively. The photodetection signals from the light emitting diodes 88*a*1, 88*b*1, and 88*c*1 are sent to the control device 24 by the photodetectors 88*a*2, 88*b*2, and 88*c*2.

The transmission sensors 88*a*, 88*b*, and 88*c* are disposed in correspondence with the standby position, the full position, and the lowest position, respectively, of the compression plate 56. The standby position of the compression plate 56 is the highest position in the moveable range of the compression plate 56, and the lowest position of the compression plate 56 is the lowest position of the moveable range of the compression plate 56. Hence, the transmission sensors 88*a* and 88*c* are used for controlling the position of the compression plate 56.

The full position of the compression plate 56 is situated between the highest and lowest positions thereof, and is a position that does not allow further vertical movement by the compression plate 56 due to the resistance of the masters 34 because the masters 34 completely fill the inside of the main body 25 of the plate discharge box 55 when the masters are compressed by the compression plate 56. In other words, the state in which the compression plate 56 stops at the disposed position of the transmission sensor 88*b* due to the resistance of the masters 34 during master compression is taken as the state in which the amount of used masters 34 inside the plate discharge box 55 is the maximum possible amount, and the transmission sensor 88*b* is configured to detect such a state.

Figure 3:
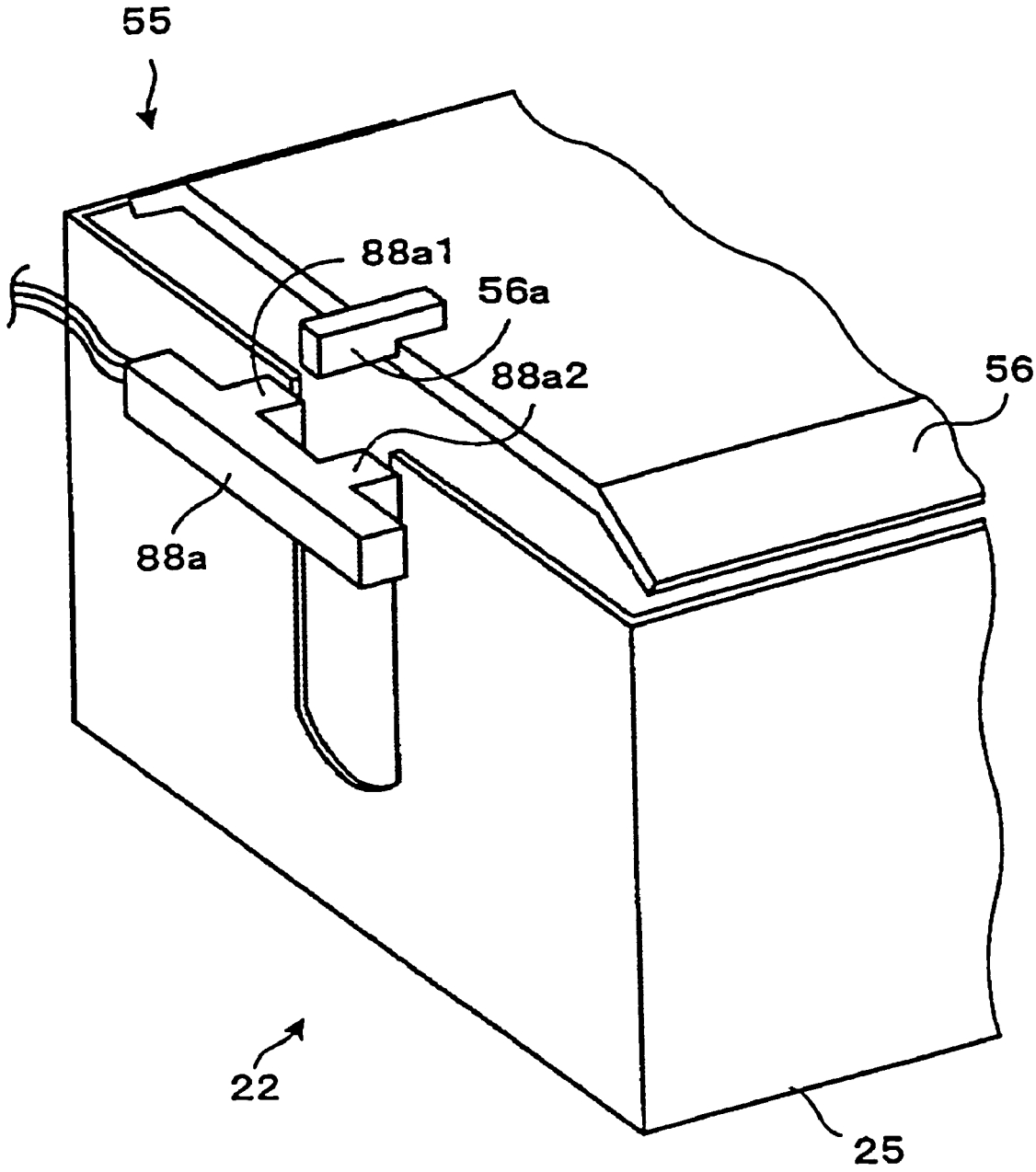
FIG. 3 is an enlarged perspective view of a portion of the plate discharge apparatus shown in FIG. 2.
Figure 4:
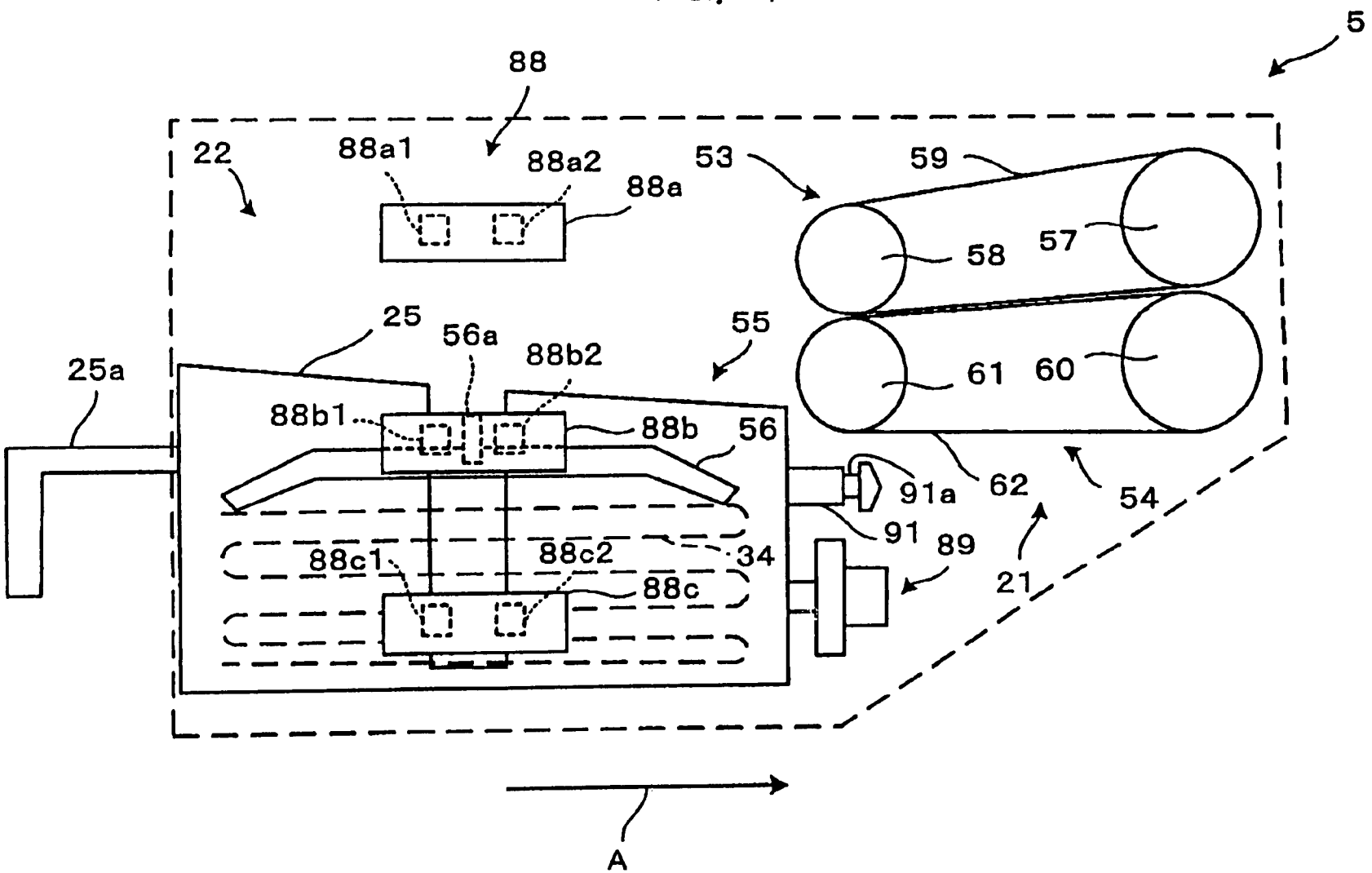
FIG. 4 is a front view for describing the operation of the plate discharge apparatus shown in FIG. 2.

For this reason, the position in which the transmission sensor 88*b* is disposed is taken as the vicinity of the top edge of the main body 25 of the plate discharge box 55, as shown in FIG. 3. In FIG. 3, the key symbol 56*a* shows a feeler protruding from the compression plate 56. It should also be noted that the transmission sensors 88*a* and 88*c* are omitted from FIG. 3.

The feeler 56*a* interrupts the transmission sensors 88*a*, 88*b*, and 88*c* when the compression plate 56 vertically moves, and passes between the light emitting diode 88*a*1 and photodetector 88*a*2, between the light emitting diode 88*b*1 and photodetector 88*b*2, and between the light emitting diode 88*c*1 and photodetector 88*c*2.

When the feeler 56*a*, disposed so as to protrude from the compression plate 56, moves between the light emitting diodes 88*a*1, 88*b*1, and 88*c*1 and photodetectors 88*a*2, 88*b*2, and 88*c*2 and interrupts the light from the light emitting diodes 88*a*1, 88*b*1, and 88*c*1, the detection signals from the photodetectors 88*a*2, 88*b*2, and 88*c*2 are switched OFF, and the control device 24 detects this condition and thereby detects the position of the compression plate 56.

Therefore, when the compression plate 56 has moved downward from the highest position, the detection signal from the photodetector 88*a*2 of transmission sensor 88*a* is switched from OFF to ON, the detection signal from the photodetector 88*b*2 of the transmission sensor 88*b* is switched from ON to OFF, and the control device 24 then determines that the amount of used masters 34 inside the plate discharge box 55 is full if a predetermined amount of time elapses in a state in which the detection signal of the photodetector 88*b*2 is OFF without the detection signal from the photodetector 88*c*2 of the transmission sensor 88*c* switching from ON to OFF.

Thus, the compression plate position detection device 88 serves as a master amount detection device for detecting the amount of used masters 34 in the plate discharge box 55. It should be noted that the master amount detection device may also be configured with the transmission sensor 88*b* alone. Also, the compression plate position detection device 88 may not be the feeler 56*a* described above, and the compression plate 56 may itself be configured to perform the detection.

As a master amount detection device configuration that differs from the compression plate position detection device 88, it is also possible to use a photosensor or another device to detect that the amount of used masters 34 has filled or has nearly filled the plate discharge box 55.

The hereinafter-described RAM 86 provided to the control device 24 may be configured so as to record the previous point in time at which the plate discharge box 55 was removed from the screen-printing apparatus 1 and the used masters 34 in the plate discharge box 55 were discarded, count the number of discharged plates from that point in time, and detect by way of this counting the amount of used masters 34 in the plate discharge box 55. In this case, the control device 24 has a master amount detection device. The point at which the count number has reached a preset count number may made to signify that the amount of used masters 34 has filled or has nearly filled the plate discharge box 55.

The mount detection device 89, as shown in FIG. 2, is disposed on the rear side of the main body 25, in other words, to the right in FIG. 2, in a mounted state in the screen-printing apparatus 1 in the direction A in which the plate discharge box 55 is mounted in the screen-printing apparatus 1 so as to engage the main body 25 of the plate discharge box 55 only when the plate discharge box 55 is mounted in the screen-printing apparatus 1.

The mount detection device 89 is a push switch, but a micro switch or another switch may also be used. The mount detection device 89 detects that the plate discharge box 55 has been mounted in a predetermined position of the screen-printing apparatus 1 by engaging the main body 25 when the plate discharge box 55 has been mounted in a predetermined position of the screen-printing apparatus 1 shown in FIG. 2, and sends a detection signal to the control device 24.

As a lock device, the lock mechanism 90 has a lock pin 91 that protrudes from the main body 25 of the plate discharge box 55, a lock plate 92 slidably supported by the side plate of the case (not shown) of the plate discharge apparatus 5, a shaft 93 that protrudes from the side plate of the case (not shown) of the plate discharge apparatus 5 and forms the sliding center of the lock plate 92, and a guide pin 94 that protrudes from the side plate of the case (not shown) of the plate discharge apparatus 5, slidably engages a guide hole 92*a* formed in one end of the lock plate 92, and keeps the sliding rage of the lock plate 92 within a fixed range, as shown in FIG. 5.

The lock mechanism 90 is slidably fixed to the side plate of the case (not shown) of the plate discharge apparatus 5, and has a keep solenoid 95 that is integrally formed with the other end of the lock plate 92 and serves as a drive source for causing the lock plate 92 to slide, a draw spring 96 as an urging aide device that is fixed to one end of the side integrally formed with the keep solenoid 95 and that is also fixed to the side plate 97 of the case of the plate discharge apparatus 5 at the other end thereof, and a micro switch 120 as a detection device for detecting the position of the lock plate 92.

A hole 92*b* through which the lock pin 91 can be inserted is formed between the support position of the shaft 93 and the guide hole 92*a* of the lock plate 92. Components other than the lock pin 91 in the lock mechanism 90 are disposed inside the main body of the screen-printing apparatus 1 in the direction A further rearward than the mounting position of the plate discharge box 55 in the screen-printing apparatus 1 so that the lock pin 91 is insertably mounted in the hole 92*b* solely in a state in which the plate discharge box 55 is moved in direction A and mounted in the screen-printing apparatus 1. As shown in FIG. 2, the lock pin 91 is disposed to the rear of the main body 25 in direction A, in other words, on right side of FIG. 2.

A groove 91*a* occupying the same position as the hole 92*b* in direction A is formed in the lock pin 91 in a state in which the lock pin 91 is insertably mounted in the hole 92*b*. Control related to the energizing of the keep solenoid 95 is carried out by the control device 24.

The keep solenoid 95 has a plunger 95*a* that moves so as to be pulled or pushed with respect to the main body thereof in accordance by the action of energizing, and the plunger 95*a* is integrated with the lock plate 92.

When the keep solenoid 95 is energized, the plunger 95*a* moves so as to be pulled into the main body of the keep solenoid 95 against the urging force of the draw spring 96 to cause the lock plate 92 to slide, as shown in the overall view of FIG. 5, a state is established in which the lock pin 91 can be inserted or removed from the hole 92*b*, and a released state is reached in which the plate discharge box 55 is allowed to be removed from the main body of the screen-printing apparatus 1.

When the keep solenoid 95 is reenergized in a state in which the lock pin 91 is inserted in the hole 92*b*, the plunger 95*a* moves so as to be pushed out of the main body of the keep solenoid 95 to cause the lock plate 92 to slide, and the hole 92*b* overlaps and engages the groove 91*a* and is set in a locked state, which is a prohibited state that prohibits the removal of the plate discharge box 55 from the main body of the screen-printing apparatus 1, as shown in the balloon portion of FIG. 5.

By engaging the lock plate 92, the micro switch 120 detects whether the lock plate 92 occupies the locked position as the prohibiting position for imparting a locked state, or whether the plate occupies the unlocked position as the release position for imparting a released state, and the detected position is output to the control device 24. The control device 24 detects whether the lock plate 92 is in the locked position or unlocked position on the basis of the signal from the micro switch 120, and controls the energizing of the keep solenoid 95. It should be noted that a push switch may be used as the micro switch 120.

Control for selectively imparting such locked and unlocked states to the lock mechanism 90 is carried out by the control device 24, which controls the energizing of the keep solenoid 95, so the control device 24 serves as a lock setting device for carrying out such control. The driving action of the keep solenoid 95 is controlled by the lock device drive circuit 115 shown in FIG. 7, which is controlled by the control device 24.

The lock mechanism 90 and the control device 24 constitute a used-master security device as a lock setting device that can prohibit the removal of the used master 34 inside the plate discharge box 55 and prevent the information recorded on the master 34 from being revealed.

The locked state can be imparted by positioning the compression plate 56 inside the main body 25, and in the case of such a configuration, the compression plate 56 comprises the lock device.

Figure 6:
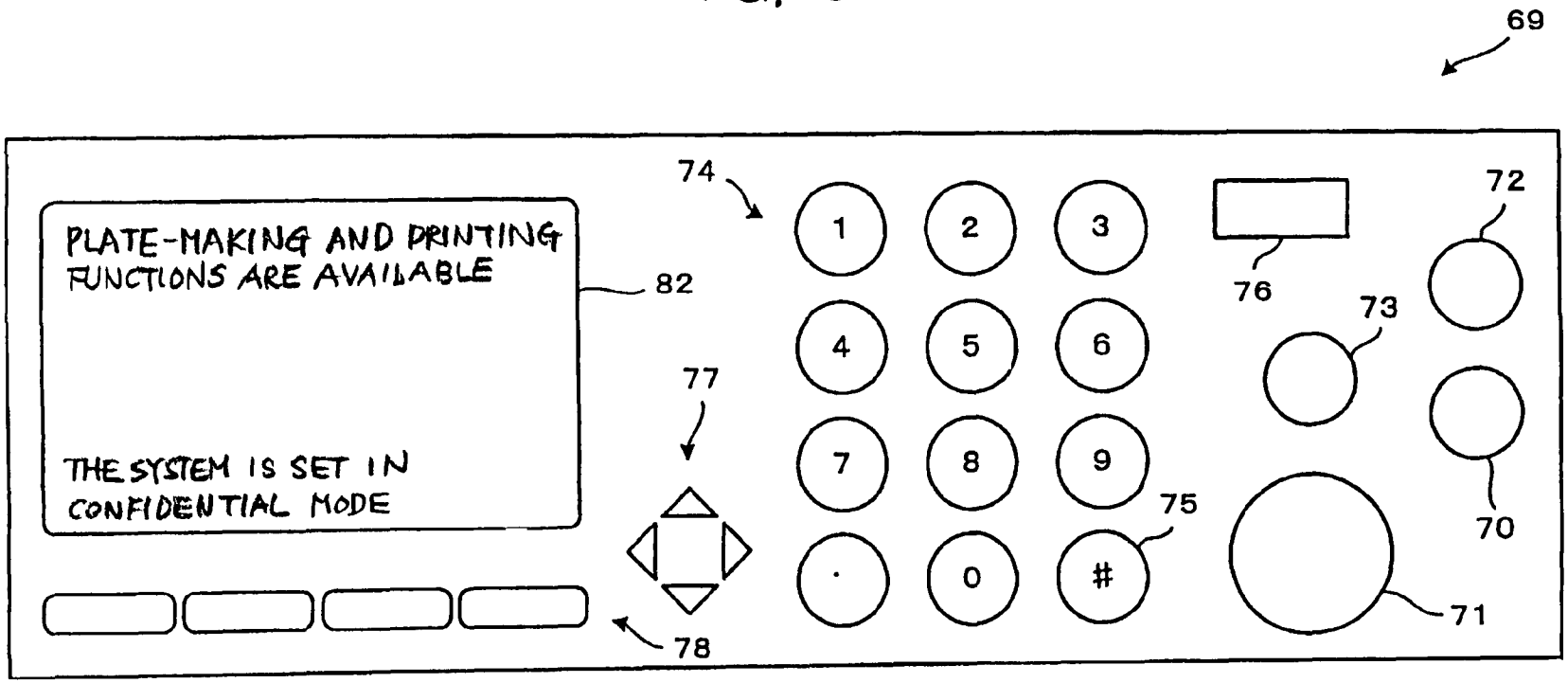
FIG. 6 is a plan view showing the control panel provided to the printing apparatus shown in FIG. 1.

The control panel 69 shown in FIG. 6 is disposed on the top front surface of the screen-printing apparatus 1. The control panel 69 has a plate-making start key 70 for starting plate-making, a printing start key 71 for starting printing, a test print key 72 as a test copy key for confirming the image position and other aspects of the final printout, a clear/stop key 73 for clearing various input conditions and stopping the printing process, a numeric keypad 74 as a group of numeric keys for inputting the number of copies to be printed and other input information, an enter key 75 for confirming various input information and the like and carrying out other actions, and a clear key 76 as a mode clear key for clearing modes and carrying out other actions.

The control panel 69 also has cursor keys 77 as a group of cursor keys for moving the display state in the display apparatus 82 (described below) and performing other actions, function keys 78 as a group of function keys for setting various states and performing other actions, and a display apparatus 82, which is a display unit that serves as a display device comprising a liquid crystal display for displaying information and is a touch panel that functions as an input device for performing various types of input.

Signals related to the operation commands from the control panel 69 are output toward the control device 24.

The control device 24 is disposed inside the case of the screen-printing apparatus 1. The control device 24 receives signals from the sensors provided to the screen-printing apparatus 1, from the control panel 69, and from other sources; displays information on the control panel 69 in accordance with the signals, and carries out other actions; and controls the entire operation of the screen-printing apparatus 1.

As shown in the circuit block diagram, which is a schematic of the electrical circuit configuration of the screen-printing apparatus 1 shown in FIG. 7, the control device 24 has a CPU 85 for performing computations, a RAM 86 as a storage device for recording various data, and a ROM 87 as a recording device for storing the control program and other data. The CPU 85, RAM 86, and ROM 87 are connected by way of a signal bus (not shown), and the control device 24 is thereby provided with a known computer configuration.

Various sensors, drive control circuits, and other components are electrically connected to the CPU 85 by way of an interface (not shown).

Specifically, the following components are connected to the CPU 85: the source document front edge detection sensor 42, the paper size detection device 52, the control panel 69, the compression plate position detection device 88, the mount detection device 89, a printing unit drive circuit 101, an ink detection device 102, a plate-making drive circuit 103, a cutter drive circuit 104, a master conveyor drive circuit 105, a read unit drive circuit 106, the paper supply drive circuit 107, a master-presence detection device 108, the paper detection device 110, the paper discharge detection device 111, the paper discharge unit drive circuit 112, the plate discharge detection device 113, the plate discharge drive circuit 114, the lock device drive circuit 115, and a lock display output device 119.

The following signals are input to the CPU 85: output signals from the source document front edge detection sensor 42, output signals from the paper size detection device 52, output signals from the control panel 69, output signals from the compression plate position detection device 88, output signals from the mount detection device 89, output signals from the ink detection device 102, output signals from the master-presence detection device 108, output signals from the paper detection device 110, output signals from the paper discharge detection device 111, and output signals from the plate discharge detection device 113.

The input signals are processed based on the operating program stored in ROM 87, and are output as operating signals to the control panel 69, printing unit drive circuit 101, plate-making drive circuit 103, cutter drive circuit 104, the master conveyor drive circuit 105, read unit drive circuit 106, paper supply drive circuit 107, paper discharge unit drive circuit 112, plate discharge drive circuit 114, lock device drive circuit 115, and lock display output device 119.

The operating program read called up from ROM 87 by the CPU 85 is temporarily written in RAM 86. The written operating program can be rewritten by input from the control panel 69.

A counter is provided to the control device 24, and when the screen-printing apparatus 1 is not used for a predetermined length of time, the apparatus switches to the power reduction standby mode in order to reduce the power consumed by the main body. The counter is also used to measure the predetermined length of time to carry out the above-described jam detection, full capacity detection, and other forms of detection.

Various signals are input from the display apparatus 82 provided to the control panel 69.

Specifically, for example, input related to mode selection can be performed from the display apparatus 82 to set either the secure mode for locking the lock mechanism 90, or the non-secure mode for establishing a released state. The reason for allowing a secure mode and a non-secure mode to be set is due to the diverse service conditions of the screen-printing apparatus 1. The display apparatus 82 that carries out this input serves as an input device for allowing the control device 24 to be set in the secure mode or non-secure mode. The mode input device may be configured with an LED in a similar manner to the lock display output device 119 described below.

Figure 9:
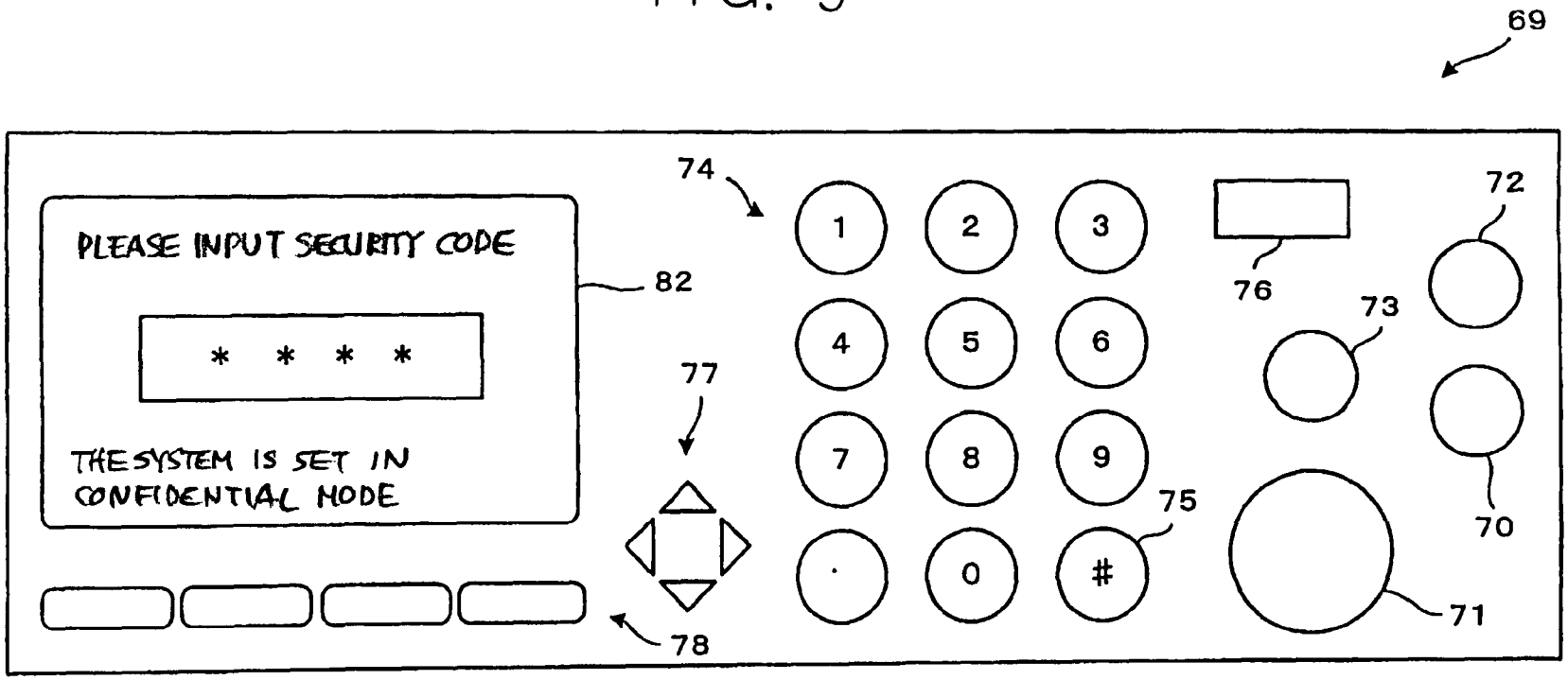
FIG. 9 is a plan view for describing the operation of the control panel shown in FIG. 6.

The mode is ordinarily selected by the personnel who install the screen-printing apparatus 1, by other personnel, or by authority of the administrator of the screen-printing apparatus 1. Therefore, switching between the secure mode and non-secure mode is carried out by the administrator, and when the mode is set, a security code must be input using the display apparatus 82, the numeric keypad 74, or another input device, as shown in FIG. 9, for example, to prevent switching by unauthorized personnel.

The program that requires inputting a security code is stored in ROM 87, and the security code for switching and setting modes is stored in RAM 86. The security code for switching and setting the modes can be rewritten by the administrator. The system can be set in the secure mode, for example, when shipped, and security code at this time can be a predetermined number provided in the appended manual or other documentation. It is also possible to configure this mode selection so that when a personal computer or another external input/output apparatus is connected to the screen-printing apparatus 1, selection can be made via the external input/output apparatus.

The secure mode program is written to RAM 86 solely when the secure mode is selected by way of the display apparatus 82. A backup memory (not shown) is provided to the RAM 86, and the secure mode program written thereto is configured so as to not be erased even in the event that the main power source of the screen-printing apparatus 1 is switched off.

The control device 24 is capable of displaying on the display apparatus 82 whether the system is in the secure mode or non-secure mode in accordance with the selection of the secure mode or non-secure mode. In FIGS. 6 and 9, for example, it is displayed on the display apparatus 82 that the system is in the secure mode.

The fact the system is in the secure mode or non-secure mode may be displayed when the operator instructs the system by way of the control panel 69 to display the mode, may be constantly displayed, may be displayed when the operator attempts to perform operations allowed only in the non-secure mode despite the fact that the system is in the secure mode, or may be displayed when the operator attempts to perform operations allowed only in the secure mode despite the fact that the system is in the non-secure mode.

The display apparatus 82 for carrying out these display operations serves as a mode display output device that is capable of displaying whether the system is in the secure mode or non-secure mode. The output indicating whether the system is in the secure mode or non-secure mode can be performed in the same manner as with the below-described warning output devices. The display apparatus 82 as the mode display output device corresponds to the warning display output device of the below-described warning output devices. The output indicating whether the system is in the secure mode or non-secure mode can be performed with the aid of a mode sound output device that corresponds to the below-described warning sound output devices.

The control device 24 does not set the lock mechanism 90 in the locked state if the plate discharge box 55 is not detected by the mount detection device 89 to be mounted in the predetermined position of the screen-printing apparatus 1 even in the secure mode. This is due to the fact that when the lock mechanism 90 is set in the locked state without the plate discharge box 55 mounted in the predetermined position of the screen-printing apparatus 1, the plate discharge box 55 cannot be mounted in the predetermined position of the screen-printing apparatus 1.

Figure 8:
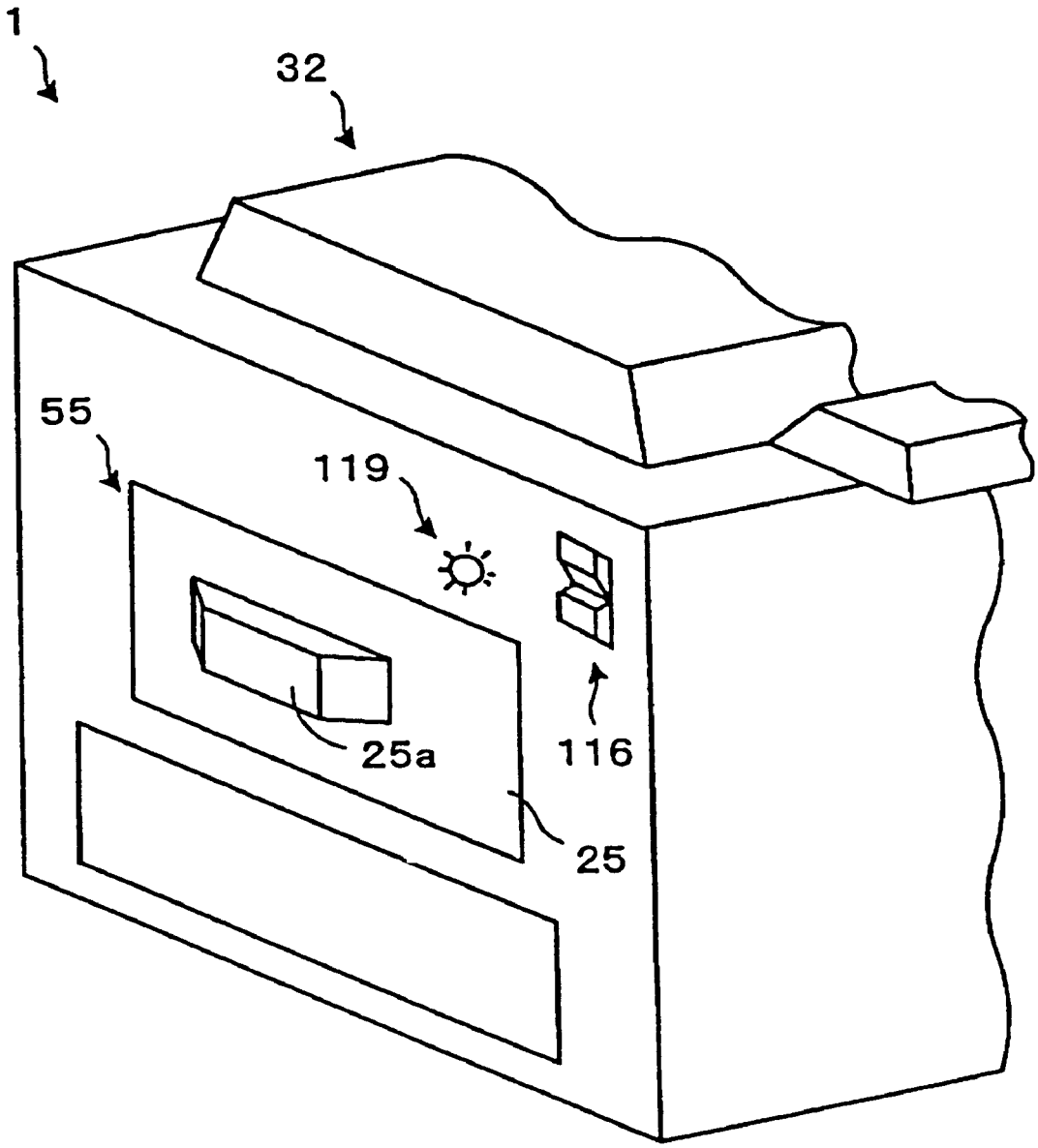
FIG. 8 is an enlarged perspective diagram of a portion of the print apparatus shown in FIG. 1.

The control device 24 displays the fact that the lock mechanism 90 is in a locked state by way of the lock display output device 119 when the lock mechanism 90 is in a locked state. The lock display output device 119 is disposed outside of the screen-printing apparatus 1 case, as shown in FIG. 8. The lock display output device 119 is composed of an LED and is lighted by the control device 24 solely when the system is in the locked state.

Hence, the lock display output device 119 displays whether the lock mechanism 90 is in a locked state or released state, that is to say, whether the plate discharge box 55 is detachable with respect to the main body of the screen-printing apparatus 1. It should be noted that in FIG. 8 the key symbol 116 shows the power switch of the screen-printing apparatus 1.

An output indicating whether the lock mechanism 90 is in a locked state or released state can be carried out in the same manner as with the below-described warning output devices. The lock display output device 119 corresponds to the warning display output device of the below-described warning output devices. An output indicating whether the lock mechanism 90 is in a locked state or released state is not limited to the lock display output device 119, and the output can be carried out with a lock state output device that corresponds to the below-described warning output devices or a lock sound output device that corresponds to the below-described warning sound output devices.

The lock display output device 119 in the present embodiment is composed of an LED, but the device may be composed of other components, or the display apparatus 82 may serve as the lock display device. When the display apparatus 82 serves as the lock display device, the display may display information only when the operator performs an operation in the control panel 69 that causes the display to be shown, may constantly display the information, or may display the information only when the an attempt is made to separate the plate discharge box 55 from the main body of the screen-printing apparatus 1 despite the fact that the system is in a locked state.

A description has already been provided for the case in which the mount detection device 89 detects whether the plate discharge box 55 is mounted in a predetermined position of the screen-printing apparatus 1, but the mount detection device 89 may also serve as a removal detection device for detecting the removal of the plate discharge box 55 from the screen-printing apparatus 1. In other words, when the mount detection device 89 detects that the plate discharge box 55 has been separated from a predetermined position of the screen-printing apparatus 1 despite the fact that the lock mechanism 90 is set in the locked state, the control device 24 detects that the plate discharge box 55 has been removed from the screen-printing apparatus 1.

This removal is unauthorized, and the control device 24 therefore outputs a warning to the display apparatus 82 to inform personnel in the area that the plate discharge box 55 has been removed from the screen-printing-apparatus 1 without authorization. The display apparatus 82 that performs this output serves as a warning output device for warning that the plate discharge box 55 has been removed from the screen-printing apparatus 1, and this output method in particular carries out the warning by display, and therefore serves as a warning display output device among the warning output devices.

The warning output device may not only be a warning display output device for displaying the fact that the plate discharge box 55 has been removed from the screen-printing apparatus 1 without authorization, as in the display apparatus 82, but may also be a speaker or another warning sound output device that emits a sound. The sound emitted by the warning sound output device may be an electronic voice for emitting the warning in spoken language, or may be an electronic sound such as a buzzer. The warning display output device and the warning sound output device may be provided together, or either one may be provided alone.

The warning output device may furthermore be provided as an entity separate from the screen-printing apparatus 1. In other words, when a personal computer or another external input/output apparatus is connected by way of a network or the like to the screen-printing apparatus 1, the external input/output apparatus may be used as a warning display output device and a warning sound output device. A speaker or another sound-producing device may be connected to the screen-printing apparatus 1 and used as the warning sound output device, and these types of external input/output apparatuses may be used as the warning sound output device. An external input/output apparatus may be jointly used with display apparatus 82. These warning actions may be controlled by the control device 24.

The control device 24 keeps the lock mechanism 90 in the locked state as long as the plate discharge box 55 is mounted in the screen-printing apparatus 1 in the secure mode. The lock mechanism 90 in the screen-printing apparatus 1 is kept in the locked state when the main body of the screen-printing apparatus 1 is in the power reduction standby mode and when the power source of the main body of the screen-printing apparatus 1 is OFF. The secure mode program written in the RAM 86 is configured so as to not be capable of being rewritten when the power source of the main body of the screen-printing apparatus 1 is switched OFF and ON.

Switching between the secure mode and non-secure mode can be performed with the condition that a security code or the like be input from the display apparatus 82 or another input device, but the screen-printing apparatus 1 has the following conditions as conditions for switching from the locked state to the released state in the secure mode.

In other words, switching may take place:

1. when input is carried out to switch from the locked state to the released state by way of the display apparatus 82,
2. when the used masters 34 have filled the plate discharge box 55, or
3. when it has been detected that used masters 34 have jammed.

Of these three conditions, the first condition, which states that switching may take place "when input is carried out to switch from the locked state to the released state by way of the display apparatus 82," may be suitably combined with the other conditions.

Switching from the locked state to the released state is ordinarily carried out by the person actually performed the printing using the screen-printing apparatus 1 or by another user of the screen-printing apparatus 1. For this reason, the above-described conditions are provided assuming that the user carries out the switching operation and that it is necessary for the user to carry out the switching operation.

Each of the conditions is described below.

Concerning the Condition "1. When Input is Carried Out to Switch from the Locked State to the Released State by Way of the Display Apparatus 82"

In the screen-printing apparatus 1, the control device 24 receives an input from the display apparatus 82 to set the lock mechanism 90 in the released state when the control device 24 has set the lock mechanism 90 in the locked state. Hence, the display apparatus 82 serves as a release input device for inputting an instruction to set the lock mechanism 90 in the released state.

Specifically, a predetermined operation is initially carried out on the display apparatus 82. This predetermined operation entails displaying a screen on the display apparatus 82 in order to switch from the locked state to the released state by way of the display apparatus 82. Operation to switch from the locked state to the released state is subsequently carried out on the screen displayed on the display apparatus 82. When this operation is complete, a screen is displayed to prompt the input of a security code as prescribed data using the display apparatus 82, the numeric keypad 74, or other input device, as shown in FIG. 9.

The program that prompts for the input of a security code is stored in the ROM 87, and the security code for switching from the locked state to the released state is stored in the RAM 86.

The code that is input via the display apparatus 82 is verified against the security code recorded in the RAM 86, and when these codes match, the control device 24 energizes the keep solenoid 95, sets the lock mechanism 90 in a released state that allows the plate discharge box 55 to be removed from the main body of the screen-printing apparatus 1, and switches off the lock display output device 119 to display the fact that the system is in a lock-released state.

When the security code recorded in the ROM 87 and the code that has been input via the display apparatus 82 do not match, the control device 24 prompts for the code to be input again. When an error has been consecutively input a prescribed number of times, the control device 24 can be configured to halt the operation of the screen-printing apparatus 1 and to issue a warning in the same manner as the above-described warning output devices.

Switching from the locked state to the released state may be automatically performed without carrying out other operations if switching from the secure mode to the non-secure mode is conditioned upon inputting a security code or the like from the display apparatus 82 or the like as described above, or the switching may be performed using solely the above-described switching operation if there is no condition to input a security code.

The security code for switching from the locked state to the released state can be rewritten from the display apparatus 82. Thus, the display apparatus 82 serves as a release data input device that allows the security code to be rewritten as specific data. Such rewriting can be carried out periodically and allows more complete security. The security code for switching from the locked state to the released state is preferably rewritten by an administrator. When the system is shipped, the security code can be set to a predetermined number and provided in the appended manual or other documentation.

The security code is stored in the backup memory of the RAM 86 and configured to not be erased in the event that the main power supply of screen-printing apparatus 1 is switched off.

The release input device and the release data input device may be disposed apart from the screen-printing apparatus 1. In other words, when a personal computer or another external input/output apparatus is connected by way of a network or the like to the screen-printing apparatus 1, the external input/output apparatus can be used as a release input device or a released data input device. The external input/output apparatus may be used in conjunction with the display apparatus 82.

When the prescribed data is electronic data as it is in the present embodiment, the release input device and the release data input device may be an IC card or another type of card. The data may also be magnetic data, a fingerprint or voice print that has to be converted to electronic form, or may be another form of data. When a card is used, for example, an ordinary known card recorder or the like may be provided to the screen-printing apparatus 1. The prescribed data is preferably electronic data from the aspect of convenience, rewritability, general usability, and other aspects, but the release input device and release data input device may be mechanisms such as key cylinders.

The device that may be used as the release input device and release data input device may be used in the same manner as the input and output devices described below.

Concerning the Condition "2. When the Used Masters 34 Have Filled the Plate Discharge Box 55"

When the plate discharge box 55 has become filled with used masters 34, this condition is detected by the compression plate position detection device 88, which serves as a master amount detection device. When the compression plate position detection device 88 detects that the plate discharge box 55 has become filled with used masters 34, the control device 24 outputs a warning indicating such a condition in the same manner as the above-described warning output devices. The device that corresponds to the warning output device described above can be referred as a "full" output device, the device that corresponds to the warning display output device described above can be referred as a "full" display output device, and the device that corresponds to the warning sound output device described above may be referred as a "full" sound output device. In the present embodiment, the display apparatus 82 is used as a "full" display output device.

The control device 24 causes the display apparatus 82 to display a prompt for inputting a security code as described above. When input has been made via the display apparatus 82, the code input via the display apparatus 82 is verified against the security code recorded in the RAM 86. When these codes match, the control device 24 energizes the keep solenoid 95, sets the lock mechanism 90 in a released state that allows the plate discharge box 55 to be removed from the main body of the screen-printing apparatus 1, and switches off the lock display output device 119 to display the fact that the system is in a lock-released state.

The control device 24 outputs an instruction in the same manner as the above-described warning output device that the used masters 34 in the plate discharge box 55 should be discarded when the lock mechanism 90 is set in a released state. The device that corresponds to the warning output device described above can be referred as a "discard" output device, the device that corresponds to the warning display output device described above can be referred as a "discard" display output device, and the device that corresponds to the warning sound output device described above may be referred as a "discard" sound output device. In the present embodiment, the display apparatus 82 is used as a "discard" display output device.

When the code input via the display apparatus 82 does not match the security code-recorded in the RAM 86, the control device 24 prompts for the code to be input again. When an error has been consecutively input a prescribed number of times, the control device 24 can be configured to halt the operation of the screen-printing apparatus 1 and to issue a warning in the same manner as the above-described warning output devices.

When it has been detected that the plate discharge box 55 has become filled with used masters 34, the control device 24 can be configured to set the lock mechanism 90 in a released state without prompting for security code input. In this case, the lock display output device 119 is preferably switched off or another action is taken to display and output the fact that the system is in a lock-released state and to output, via the above-described "discard" output device, an instruction that the masters 34 should be discarded.

When the configuration of the master amount detection device differs from the compression plate position detection device 88, and when it can be detected that the amount of used masters 34 in the plate discharge box 55 is close to full, the control device 24 can thereby issue a prompt to input the security code as described above, produce an output to this effect, or issue a warning to this effect in the same manner as in the case of the above-described warning output device if an error has been consecutively input a prescribed number of times.

Concerning the Condition "3. When it has Been Detected that Used Masters 34 Have Jammed"

As described above, the plate discharge detection device 113, acting as a jam detection device, detects that the used masters 34 have jammed. When the plate discharge detection device 113 has detected that the used masters 34 have jammed, the control device 24 sets the lock mechanism 90 in a released state without prompting for security code input and switches off the lock display output device 119 to display that the system is in a lock-released state.

In other words, when used masters 34 are detected to have jammed, the control device 24 will always set the lock mechanism 90 in a released state. This is due to the fact that when a jam has occurred, the plate discharge box 55 must be removed from the screen-printing apparatus 1 and the jam resolved, so the urgency is greater than when a "full" condition has been detected.

When used masters 34 are detected to have jammed, the control device 24 may be configured to display on the display apparatus 82 a prompt to input the security code in the same manner as described above. In this case, when input has been made via the display apparatus 82, the code that has been input via the display apparatus 82 is verified against the security code recorded in the RAM 86. When these codes match, the control device 24 sets the lock mechanism 90 in a released state and switches off the lock display output device 119 to display the fact that the system is in a released state.

When the security code recorded in the RAM 86 and the code inputted via the display apparatus 82 do not match, the control device 24 prompts for the code to be input again. When an error has been consecutively input a prescribed number of times, the control device 24 can be configured to halt the operation of the screen-printing apparatus 1 and to issue a warning in the same manner as the above-described warning output devices.

The display apparatus 82 can be set whether to cause the control device 24 to always set the lock mechanism 90 in a released state when the used masters 34 are detected to have jammed. The display apparatus 82 will thereby serve as a jam resolve setting input device for setting whether the control device 24 always sets the lock mechanism 90 is the released state when the plate discharge detection device 113 detects that used masters 34 have jammed.

The reason for allowing such a setting is that the screen-printing apparatus 1 is sometimes used in various service conditions and screen-printing apparatus service environments. For example, security is sometimes emphasized and the system needs to remain secure even when jams occur. The system may also be limited to departmental use, or the users may be specified, or priority may be given to making the screen-printing apparatus 1 more widely available rather than to maintaining security.

The settings may require inputting a security code in the same manner as described above. The security code can be handled in the same manner as the security code set by the administrator as described above, so a description thereof has been omitted.

When the used masters 34 are detected to have jammed, the control device 24 can indicate that a jam has occurred in the same manner as the above-described warning output device. In this case, the device that corresponds to the warning output device described above can be referred as a "jam" output device, the device that corresponds to the warning display output device described above can be referred as a "jam" display output device, and the device that corresponds to the warning sound output device described above may be referred as a "jam" sound output device.

Under each conditions for setting the released state as described above, when an attempt has been made to remove the plate discharge box 55 from the screen-printing apparatus 1 in a state in which security code input is being prompted, a warning is output to indicate that an unauthorized attempt has been made to remove the plate discharge box 55. However, when the operation to input a security code and the operation to remove the plate discharge box 55 have simply been mistaken, the operator may experience stress as a result of the warning of an unauthorized operation. When an attempt is made to remove the plate discharge box 55 from the screen-printing apparatus 1 in a state in which security code is being prompted, the system can be configured to simply urge that the security code be input again using the same output device described above.

The operation of the screen-printing apparatus 1 is described below with reference to FIGS. 10 and 11 on the basis of the above-described configuration.

Figure 10:
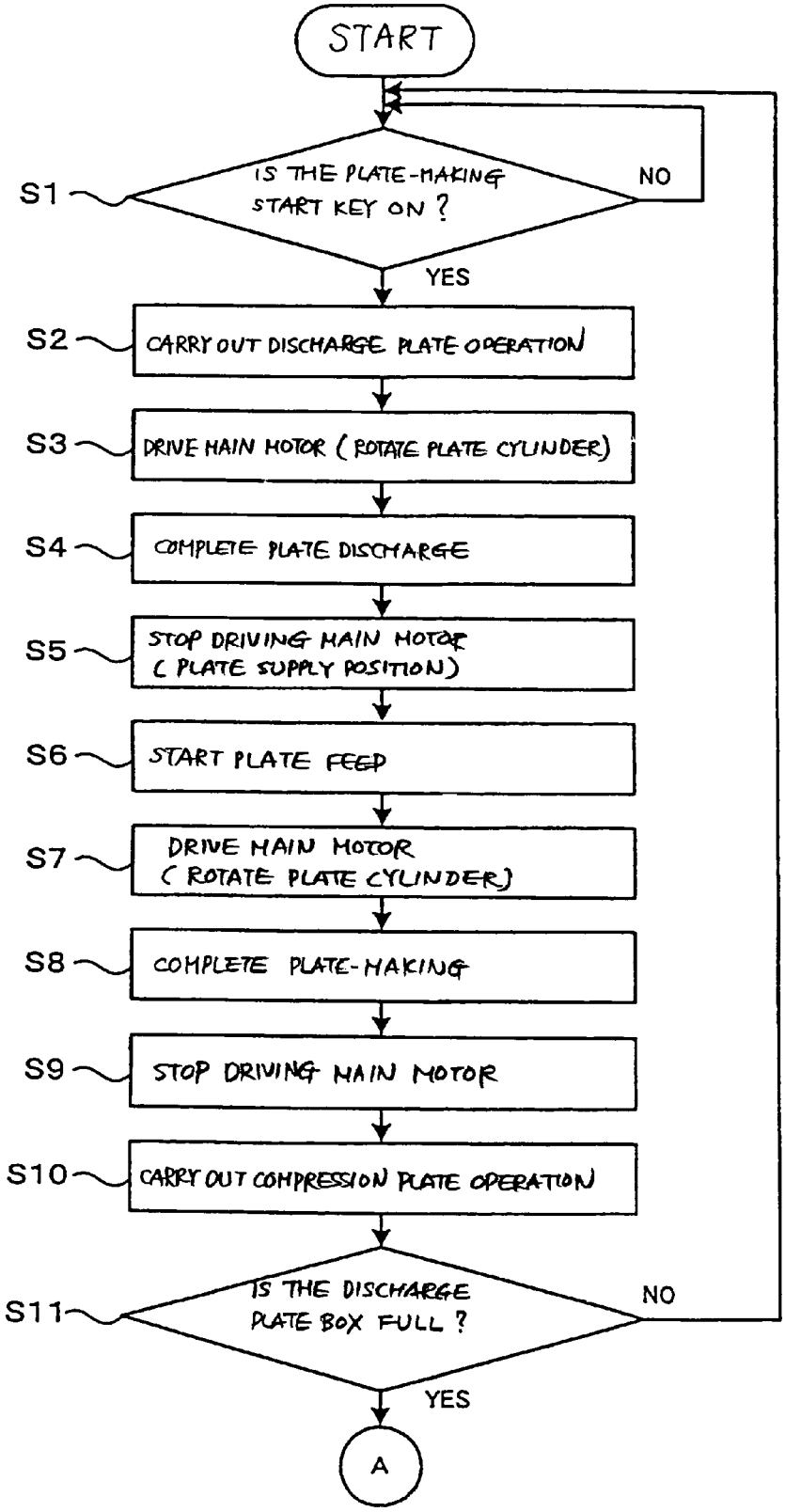
FIG. 10 is a front view showing the first half of the flowchart related to a portion of the operation of the printing apparatus shown in FIG. 1.

When a source document is set in the source document setting unit 40 by setting the leading end of the source document against the nip of the pair of source document conveyance rollers 41, the plate-making conditions are set by operating the keys on the control panel 69, the plate-making start key 70 is pressed ((S1) in FIG. 10), the pair of source document conveyance rollers 41 and the pair of source document conveyance rollers 45 are driven by the stepping motor, and the source document is conveyed.

When the leading end of the document is detected by the document front edge detection sensor 42, the document is conveyed a predetermined distance in accordance with the control procedure performed by the control device 24 on the basis of the data recorded in the ROM 87. The document is read by the CIS 43 during the conveyance process, and the document image thus read is sent to the CPU 85 as an image data signal. When the stepping motor is driven a predetermined amount, and the leading end of the document is conveyed to a predetermined position on the document discharge tray 33, the driving action of the stepping motor is halted and the conveyance of the document is stopped.

Plate discharge operation for separating the used master 34 from the external peripheral surface of the plate cylinder 7 is carried out in the plate discharge apparatus 5 in conjunction with the image reading operation of the document reading apparatus 32 ((S2) in FIG. 10). The plate cylinder 7 in which the used master 34 is wound on external peripheral surface thereof is rotatably driven by the main motor on the basis of an operation signal from the CPU 85, and rotation is started in the counterclockwise direction in FIG. 1 ((S3) in FIG. 10).

When the trailing end of the used master 34 wound on the external peripheral surface of the plate cylinder 7 arrives at a predetermined plate discharge position that corresponds with the master removal mechanism 21, the master removal mechanism 21 moves to the plate cylinder 7 side, comes into contact with the used master 34 on the external peripheral surface of the plate cylinder 7, and lifts the used master 34. The used master 34 is held between the lower plate discharge member 54 and the upper plate discharge member 53, separated from the external peripheral surface of the plate cylinder 7, and conveyed by the rubber belts 59 and 62 to be discarded in the plate discharge box 55.

When the used master 34 is completely removed from the external peripheral surface of the plate cylinder 7 and the discharge operation is complete ((S4) in FIG. 10), the plate cylinder 7 is rotated further. When the plate cylinder 7 arrives at the home position, which is the predetermined plate supply position shown in FIG. 1, the main motor is stopped, the rotation of the plate cylinder 7 is halted ((S5) in FIG. 10), the clamper 11 is rotated in the clockwise direction, and the plate cylinder 7 is brought to the plate supply standby state.

When the plate discharge operation is complete, the plate-making operation is subsequently carried out in conjunction with the image reading operation in the source document reading apparatus 32. When the plate cylinder 7 enters a plate supply standby state, the stepping motor operates in accordance with the operation signal from the CPU 85, the platen roller 36 and the drive rollers 31*a* and 31*c* are rotatably driven, and the master 34 is drawn from the master roll 35.

When the CPU 85 determines from the number of steps taken by the stepping motor that the image formation area of the master 34 has reached the position that corresponds with the heating elements of the thermal head 37, that is to say, the plate-making position, an operation signal is sent by the CPU 85, the heating elements of the thermal head 37 are selectively heated based on the image data signals sent by the source document reading apparatus 32, and a screen-printing image is formed on the master 34. It should be noted that the CPU 85 drives the stepping motor of the source document reading apparatus 32 when the master 34 arrives at the plate-making position.

The master 34 on which the screen-printed image is formed is guided by the guide plates 38 and 39 while being conveyed to the clamper 11 by the conveyance device 31. When the CPU 85 determines from the number of steps taken by the stepping motor that the leading end of the master 34 has arrived at the clamper 11 and the plate feed has started ((S6) in FIG. 10), the clamper 11 is closed to grasp the leading end of the master 34. The plate cylinder 7 is rotatably driven by the main motor in the clockwise direction at the same velocity as the conveyance velocity of the master 34 ((S7) in FIG. 10), the master 34 is wound onto the plate cylinder 7, and the plate feeding action is continued.

The CPU 85 determines from the number of steps taken by the stepping motor during the winding process that a single plate has been processed. The CPU 85 stops the rotation of the platen roller 36 and the drive rollers 31*a* and 31*c*, and the movable blade 30*b* is rotatably moved to cut the master 34. The master 34 continues to be drawn by the rotating action of the plate cylinder 7 after being cut, a single master 34 is wound, plate feeding is completed ((S8) in FIG. 10) when the plate cylinder 7 arrives at the home position, and the driving action of the main motor is halted ((S9) in FIG. 10) to complete the winding operation.

In this case, the used masters 34 discarded in the plate discharge box 55 are compressed by the compression plate 56 ((S10) in FIG. 10). The compression plate position detection device 88 detects whether the plate discharge box 55 is full of used masters 34 ((S11) in FIG. 10) on the basis of the movement of the compression plate 56 during compression.

After the winding operation, the plate imprint operation is carried out. When the plate cylinder 7 stops at the home position, the plate cylinder 7 is rotatably driven at low velocity and the paper supply roller 47, separation roller 48, drive roller 65, and suction fan 67 are rotatably driven. Of the plurality of printing paper P stacked on the paper supply tray 46, the highest single sheet of printing paper P is drawn by the rotation of the paper supply roller 47 and separation roller 48, and grasped by the pair of resist rollers 49.

When the leading end of the image area of the master 34 wound on the plate cylinder 7 in the rotational direction of the plate cylinder 7 arrives at the position corresponding to the press roller 9, an operation signal is sent by the CPU 85 to rotate the pair of resist rollers 49, and the printing paper P is fed to the nip unit N. After the CPU 85 sends the operation signal to the pair of resist rollers 49, the press roller 9 is caused to slide. The printing paper P fed from the pair of resist rollers 49 is pressed by the press roller 9 against the master 34 wound on the plate cylinder 7.

The press roller 9, printing paper P, master 34, and the external peripheral surface of the plate cylinder 7 are compressed by the compressive action, and ink fed to the internal peripheral surface of the plate cylinder 7 by the ink roller 14 effuses through the mesh screen and the apertures in the external peripheral surface of the plate cylinder 7. The ink thereafter fills the gaps between the master 34 and the external peripheral surface of the plate cylinder 7, and is transferred to the printing paper P via the perforated portion of the master 34.

The printing paper P to which ink has been transferred is removed from the external peripheral surface of the plate cylinder 7 by the leading end of the removal pawl 63 and dropped downward to be attracted to the upper surface of the rubber belt 66 by the attraction force of the suction fan 67 while being conveyed in the leftward direction, and is then discharged onto the paper discharge tray 68. The plate imprint operation is completed by way of this series of steps, and the screen-printing apparatus 1 is set in a printing standby state.

When the operator presses the test print key 72 on the screen-printing apparatus 1, which has completed the steps of reading a source document, discharging a plate, and printing, and has been set in the printing standby state, the highest single sheet of printing paper on the paper supply tray 46 is drawn by the paper supply roller 47 and separation roller 48 in the same manner as in the plate imprint operation and is grasped by the pair of resist rollers 49, and the plate cylinder 7 is rotatably driven at high velocity by the main motor.

The pair of resist rollers 49 feeds printing paper P with the same timing as in the plate imprint operation between the fast-rotating plate cylinder 7 and the press roller 9. The printing paper P thus fed is pressed to the master 34 wound on the plate cylinder 7 by the press roller 9 to transfer ink thereto. A print image is formed on the surface thereof, and the paper is thereafter removed from the external peripheral surface of the plate cylinder 7 by the removal pawl 63 and conveyed in the leftward direction by the rubber belt 66 to be discharged into the paper discharge tray 68. The plate cylinder 7 returns to the home position and the test print operation is completed.

The density and position of the printed image is checked using this test print, the parameters are adjusted via the keys on the control panel 69, the number of copies to print is specified using the numeric keypad 74, various settings are carried out, and the printing start key 71 is thereafter pressed. Printing paper P is thereby continuously fed by the paper supply apparatus 4 to carry out the printing operation. The plate cylinder 7 again returns to the home position upon completion of the printing operation.

Figure 11:
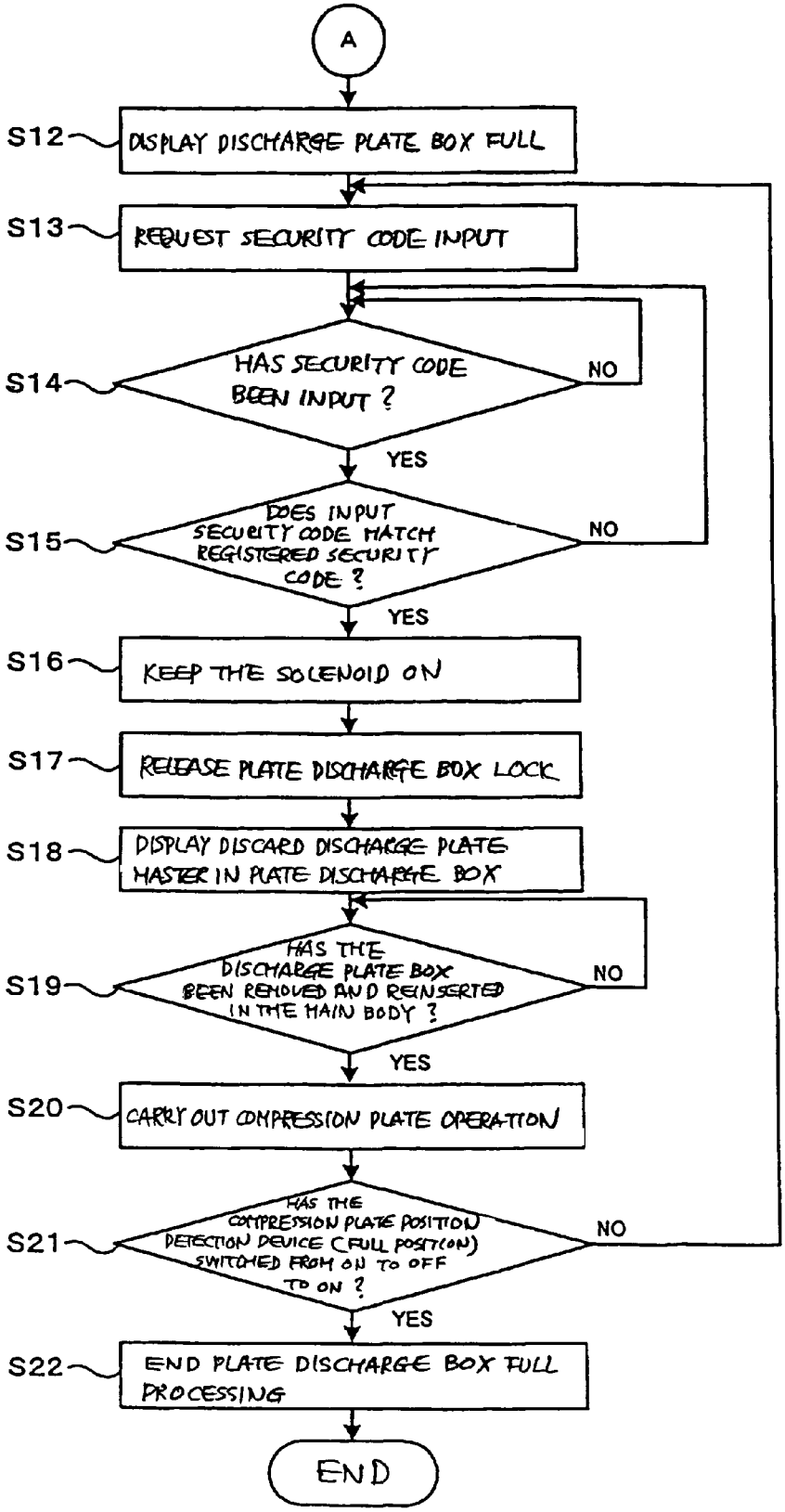
FIG. 11 is a front view showing the second half of the flowchart related to a portion of the operation of the printing apparatus shown in FIG. 1.

When the compression plate position detection device 88 detects that the plate discharge box 55 is full of used masters 34, the control device 24 outputs via the display apparatus 82 information that the plate discharge box 55 is full of used masters 34 ((S12) in FIG. 11). When the plate discharge box 55 is full of used masters 34, the system prepares ((S1) in FIG. 10) for the plate-making start key 70 to be pressed again.

The control device 24 causes the display apparatus 82 to display the fact that the plate discharge box 55 is full of used masters 34, and then displays on the display apparatus 82 a prompt to input the security code ((S13) in FIG. 11). When input has been carried out by the display apparatus 82 ((S14) in FIG. 11), the code input via the display apparatus 82 is verified against the security code recorded in the RAM 86, and a determination is made as to whether the codes match ((S15) in FIG. 11).

When the code input via the display apparatus 82 is verified against the security code recorded in the RAM 86, the control device 24 energizes the keep solenoid 95 ((S16) in FIG. 11), sets the lock mechanism 90 in a released state ((S17) in FIG. 11) that allows the plate discharge box 55 to be removed from the main body of the screen-printing apparatus 1, and switches off the lock display output device 119 to display the fact that the system is in a released state.

The control device 24 outputs via the display apparatus 82 information that the used masters 34 in the plate discharge box 55 should be discarded ((S18) in FIG. 11). When the security code recorded in the ROM 87 and the code input via the display apparatus 82 do not match, the control device 24 prompts for the code to be input again.

The control device 24 monitors via the mount detection device 89 the situation from the time the plate discharge box 55 is removed from the screen-printing apparatus 1 until the time the box is remounted ((S19) in FIG. 11), and when the mount detection device 89 has detected that the plate discharge box 55 has been removed from the screen-printing apparatus 1 and remounted, the same operation is carried out ((S20) in FIG. 11) as when the used masters 34 discarded in the plate discharge box 55 are compressed by the compression plate 56 to verify that the used masters 34 in the plate discharge box 55 have been discarded.

The compression plate position detection device 88 detects whether the plate discharge box 55 is filled with used masters 34 ((S21) in FIG. 11) on the basis of the movement of the compression plate 56. When the movement of the compression plate 56 indicates that the plate discharge box 55 is full of used masters 34, the control device 24 returns to the step ((S13) in FIG. 11) to again display on the display apparatus 82 a prompt for security code input.

When the movement of the compression plate 56 indicates that the plate discharge box 55 is not full of used masters 34, the control device 24 determines that the used masters 34 in the plate discharge box 55 have been discarded, and the series of the steps that is followed when the box is full of used masters 34 is completed.

Figure 12:
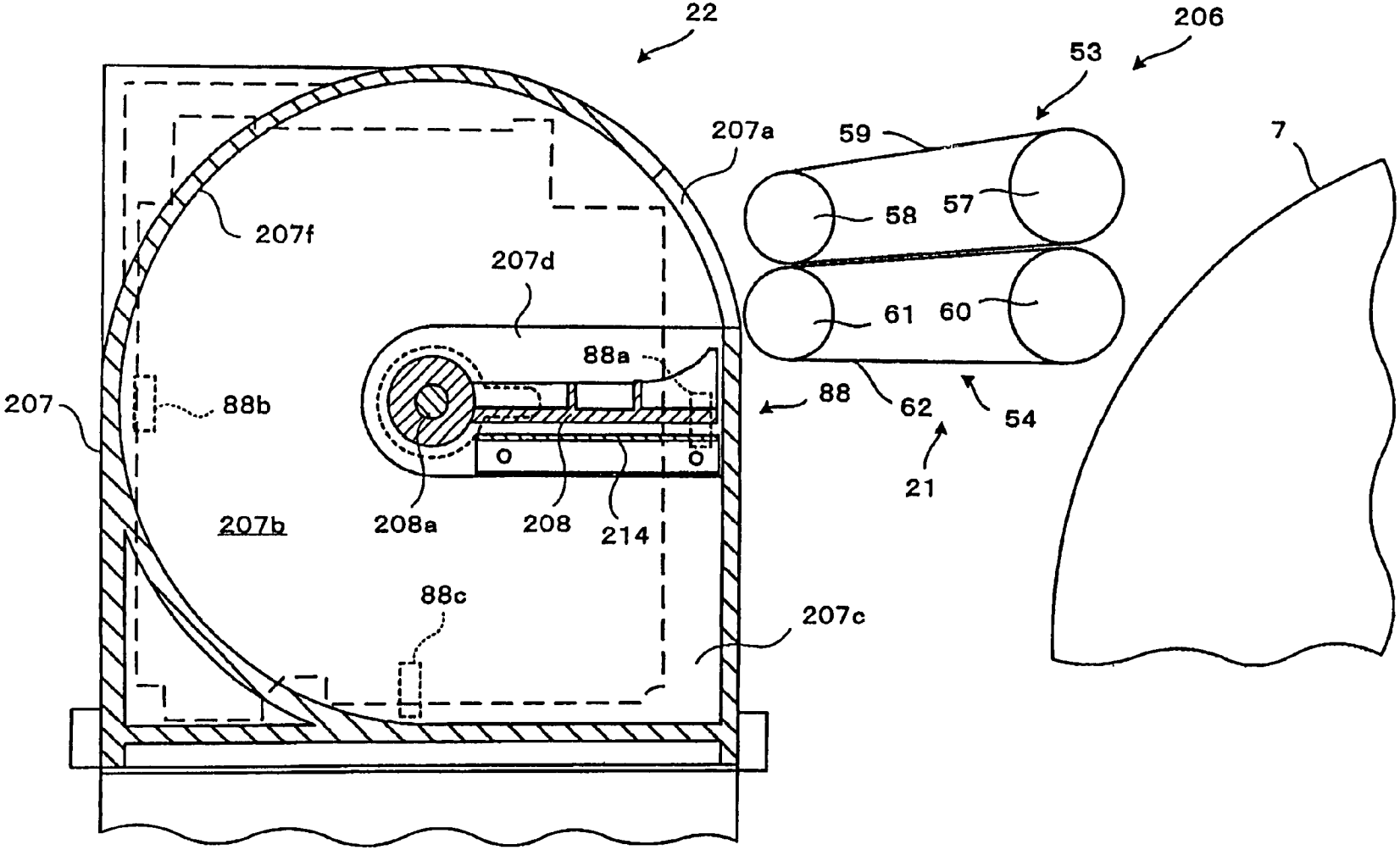
FIG. 12 is a front cross-sectional view showing another structural example of the discharge apparatus mounted in the printing apparatus shown in FIG. 1.
Figure 13:
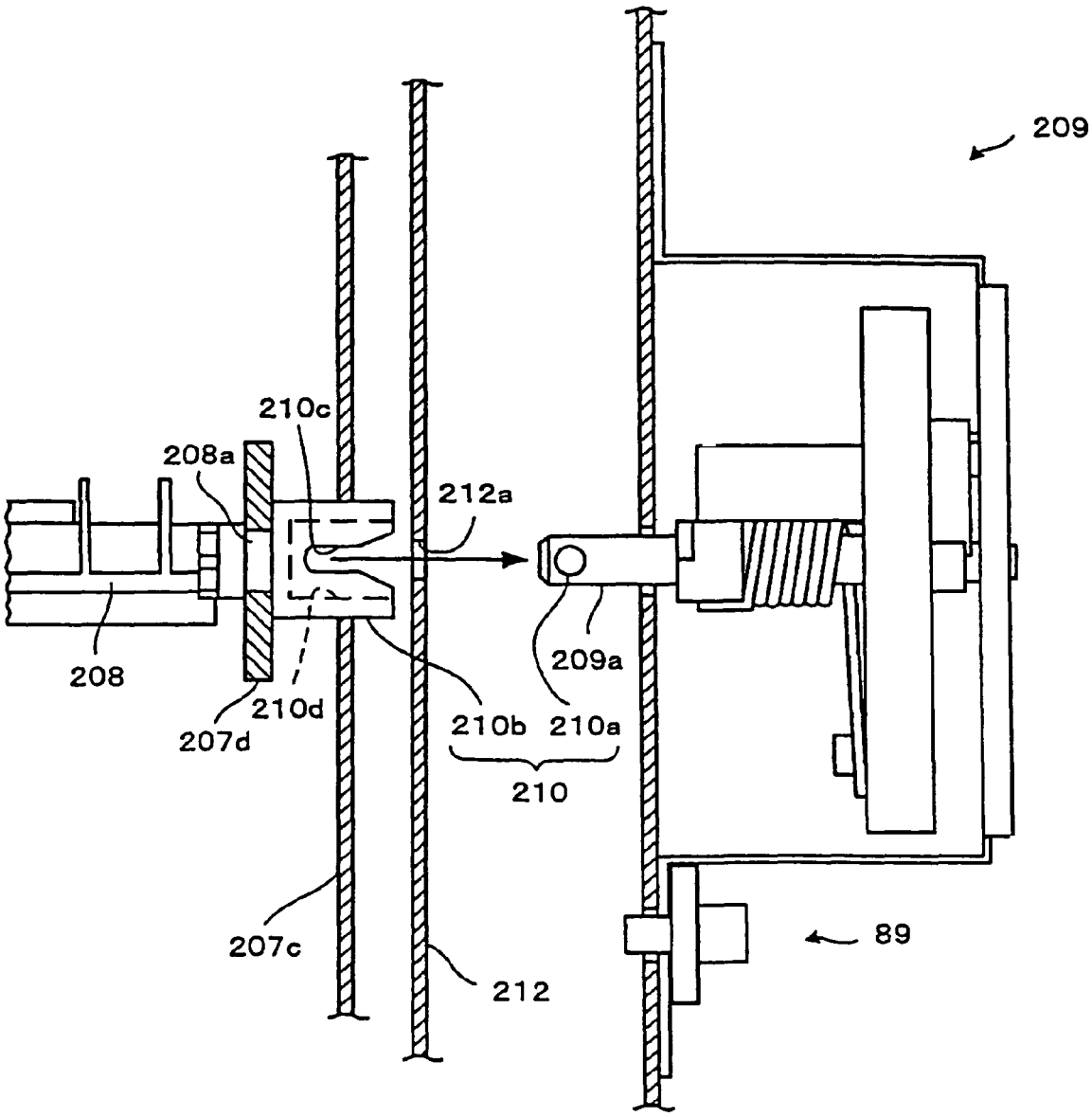
FIG. 13 is a side cross-sectional view of the discharge apparatus shown in FIG. 12.
Figure 14B:
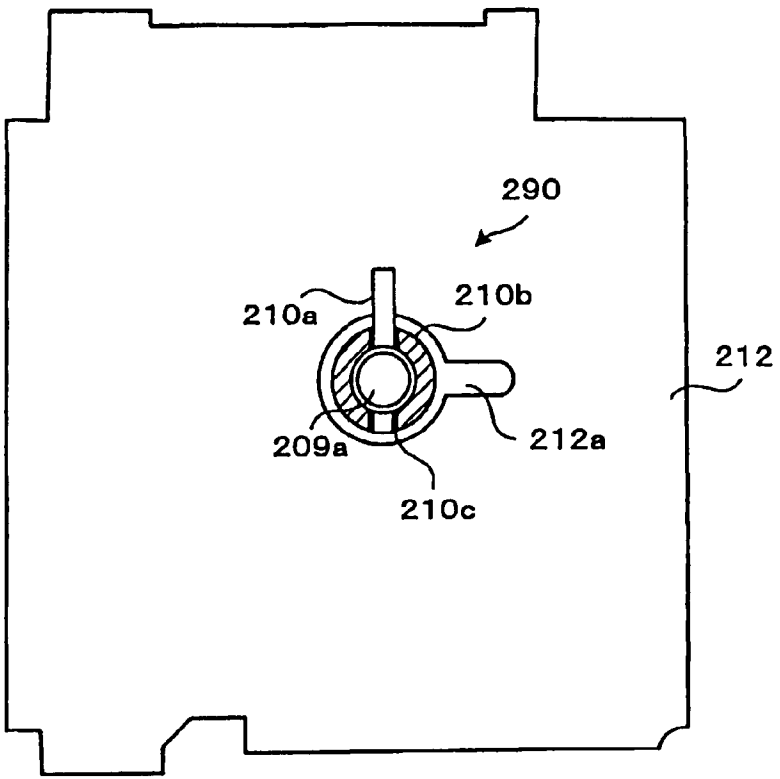
FIG. 14 is a front cross-sectional view for describing the operation of the discharge apparatus shown in FIG. 12.
Figure 14A:
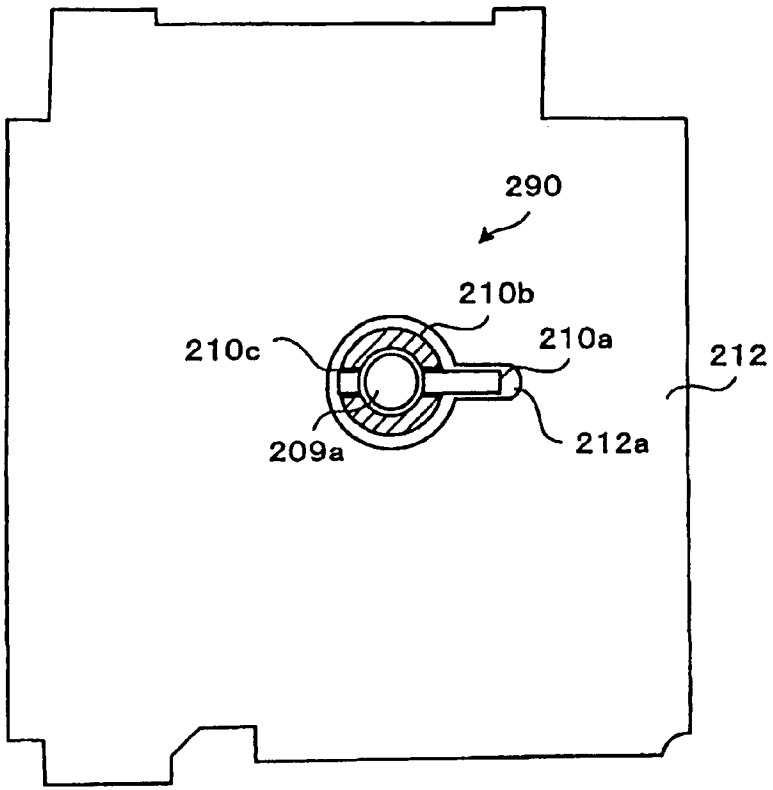

The configuration of the plate discharge apparatus is not limited to one in which the compression plate uses translational movement, as shown in FIG. 1 and other diagrams, and rotational movement is also possible, as shown in FIGS. 12 to 14. The configuration of the plate discharge apparatus is not limited to one in which the detachable direction of the used-master storage device is substantially parallel to the conveyance direction of the paper, as shown in FIG. 1 and other diagrams, and a substantially perpendicular direction is also possible, as shown in FIGS. 12 to 14.

Primarily discussed below are the portions of the plate discharge apparatus 206 shown in FIGS. 12 to 14 that differ from the above-described plate discharge apparatus 5.

The plate discharge apparatus 206, as shown in FIG. 12, has the same master removal mechanism 21 as described above, a plate discharge storage unit 222, and the same plate discharge detection device 113 as described above and shown in FIG. 7.

The plate discharge storage unit 222 stores used masters 34 that have been removed from the plate cylinder 7 by the master removal mechanism 21, and has a plate discharge box 207, which is a plate discharge storage box that serves as a used-master storage device for storing used masters 34; a compression plate 208 for compressing the used masters 34 stored in the plate discharge box 207; a compression plate position detection device 88 as a master quantity detection device that differs from the above-described same device in mounting position only; a mount detection device 89, which is the same as described above and which is a plate discharge box presence detection device that serves as the plate discharge box detection device shown in FIG. 13; the plate discharge box cover 212 shown in FIGS. 13 and 14 that is integrally formed with the plate discharge box 207 and covers and secures the plate discharge box 207; and the drive device 209 shown in FIG. 13 for driving the compression plate 208. The plate discharge storage unit 222 has a compression device for compressing the used masters 34.

The plate discharge box 207 has a substantially cylindrical shape as shown in FIGS. 12 and 13, a master delivery port 207*a* is formed in the upper portion, and the interior forms the master storage unit 207*b* for storing used masters 34. A portion of the inside wall 207*f* of the plate discharge box 207 is formed along the movement path through which the free end of the compression plate 208 rotates by 270° as the distal end side. The plate discharge box 207 is connected to the inside wall 207*f*, and the inside wall is shaped as a box from the portion of the free end of the compression plate 208 that exceeds 270°.

A divider 214 is fixedly disposed in the innermost portion of the master storage unit 207*b* to prevent used masters 34 stored in the plate discharge box 207 from overflowing toward the master delivery port 207*a* (*7), and to restrict the compression plate 208 from excessively rotating in the clockwise direction in FIG. 12 and moving to the home position of the compression plate 208 shown in FIG. 12.

The compression plate 208 is a member for compressing the used masters 34 stored in the plate discharge box 207, and the plate is disposed inside the plate discharge box 207. The compression plate 208 has a support shaft 208*a* on the base portion thereof, and rotates freely about the center of rotation of the center portion of the master storage unit 207*b* by being pivoted at substantially the center portion of the wall portion (not shown) of the plate discharge box 207 disposed in the innermost side in FIG. 12, and at the bracket unit 207*d* fixed to the area of the wall portion 207*c* of the plate discharge box 207 disposed in the inner side in FIG. 12, so as to be substantially parallel to the direction perpendicular to the paper surface in FIG. 12. The compression plate 208 is thereby configured to rotate inside the plate discharge box 207 about the center area of the master storage unit 207*b*. The compression plate 208 has a feeler (not shown) that is detected by the compression plate position detection device 88.

The compression plate 208 is be rotated inside the plate discharge box 207 by about 270° about the center of the support shaft 208*a* from the standby position, which is the home position of the compression plate 208 shown in FIG. 12. When a used master 34 thereby passes through the master delivery port 207*a* and is conveyed to a position above the compression plate 208 inside the plate discharge box 207, the compression plate 208 begins to rotate so as to lift with the used masters 34 resting thereon, and is rotated by about 270° in the counterclockwise direction. The used master 34 is stored in compressed state in the inner portion of the master storage unit 207*b* by the rotation of the compression plate 208. The compression plate 208 rotates by about 270° and thereafter returns to the standby position. Thus, the compression plate 208 rotates in a reciprocating manner between the standby position and the position rotated by about 270°.

The compression plate position detection device 88 has transmission sensors 88*a*, 88*b*, and 88*c* as three detection devices disposed in the rotational direction of the compression plate 208. The transmission sensors 88*a*, 88*b*, and 88*c* are disposed in correspondence with the standby position, full position, and maximum position of moveable range of the compression plate 208, respectively. The maximum position of the moveable range of the compression plate 208 is defined as the position to which the compression plate 208 has rotated about 270° from the standby position. Hence, the transmission sensors 88*a* and 88*c* are used for controlling the positions of the compression plate 56.

Meanwhile, the full position of the compression plate 208 is between the standby position and the maximum position of the moveable range, and is the position at which the compression plate 208 cannot rotate further due to the resistance of the master 34 because a predetermined amount of masters 34 has been stored in the master storage unit 207*b* during master compression of the compression plate 208. In other words, the point at which the compression plate 208 stops at the position of the transmission sensor 88*b* due to the resistance of the master 34 during master compression is the state in which the amount of used masters 34 in the plate discharge box 55 is full, and the transmission sensor 88*b* is designed to detect this state.

The position of the transmission sensor 88*b*, as shown in FIG. 12, is one in which the compression plate 208 has rotated 180°. The feeler interferes with the transmission sensors 88*a*, 88*b*, and 88*c* during the rotatable movement of the compression plate 208, and is detected by the transmission sensors 88*a*, 88*b*, and 88*c*.

The drive device 209 has a drive shaft 209*a*, as shown in FIG. 12. A coupling pin 210*a* is provided in a protruding manner to the tip of the drive shaft 209*a*. A cylindrical coupling main body 210*b* is fixedly provided to the tip of the support shaft 208*a* of the compression plate 208. Formed on the coupling main body 210*b* are a coupling groove 210*c* with which the coupling pin 210*a* engages, and a coupling hole 210*d* into which the shaft end portion of the drive shaft 209*a* is fitted. The coupling 210 is composed of the coupling pin 210*a* and the coupling main body 210*b*. The drive device 209 is controlled by the plate discharge drive circuit 114 shown in FIG. 7, which is controlled by the control device 24.

This type of configuration allows the driving force of the drive device 209 to rotatably drive the compression plate 208 by transmitting the rotation of the drive shaft 209*a* to the support shaft 208*a* by way of the coupling 210.

The plate discharge box 207 can be detached from the main body of the screen-printing apparatus 1 together with the compression plate 208.

In other words, when the plate discharge box 207 in FIG. 13 is moved rightward, the coupling hole 210*d* fits over the axle end portion of the drive shaft 209*a*, the coupling groove 210*c* engages the coupling pin 210*a*, the plate discharge box 207 is mounted on the main body of the plate discharge apparatus 206 and the main body of the screen-printing apparatus 1, and the rotation of the drive shaft 209*a* can be transmitted to the support shaft 208*a*. In this state, the plate discharge box cover 212 engages the mount detection device 89, and the mount detection device 89 detects that the plate discharge box 207 has been mounted in a predetermined position of the screen-printing apparatus 1.

When the plate cylinder 7 is moved leftward in FIG. 13, the coupling pin 210*a* and the coupling groove 210*c* are disengaged, the coupling hole 210*d* separates from the shaft end portion of the drive shaft 209*a*, the support shaft 208*a* is separated together with the plate discharge box 207 from the main body of the screen-printing apparatus 1 and the main body of the plate discharge apparatus 206, and the plate discharge box 207 is detached from the screen-printing apparatus 1.

Meanwhile, in the plate discharge apparatus 206, the rotation of the drive shaft 209*a* is transmitted to the support shaft 208*a* by way of the coupling 210, so if the relative rotational positions of the coupling groove 210*c* and the coupling pin 210*a* do not conform when mounting the plate discharge box 207 to the main body of the plate discharge apparatus 206 and the main body of the screen-printing apparatus 1, the mounting of the plate discharge box 207 tends to be incomplete, or the coupling groove 210*c* and the coupling pin 210*a* tend to be coupled out of phase by 180°.

In the same manner as the lock mechanism 90 in the plate discharge apparatus 5, a lock device must be provided to impart, by way of the control device 24 as a lock setting device, either a prohibited state for prohibiting the removal of the plate discharge box 207 from the main body of the screen-printing apparatus 1, or a released state for allowing the removal of the plate discharge box 207 from the main body of the screen-printing apparatus 1.

In view of the above, the plate discharge apparatus 206 is configured so as to allow the coupling groove 210*c* and the coupling pin 210*a* to engage each other and to allow the plate discharge box 207 to be detachable from the main body of the plate discharge apparatus 206 and the main body of the screen-printing apparatus 1 only when the support shaft 208*a* of the compression plate 208 is in the home position, and the drive shaft 209*a* is in the home position.

In other words, an engagement hole 212*a* in the form of a key hole is provided to the plate discharge box cover 212, as shown in FIG. 14, and the engagement hole 212*a* is configured to impart a released state that allows the plate discharge box 207 to be removed from the screen-printing apparatus 1 because the coupling pin 210*a* can be inserted or removed and the plate discharge box 207 can be made detachable from the screen-printing apparatus 1 solely when the rotational position of the drive shaft 209*a* is in the home position, as shown in FIG. 14(*a*).

In the state in which the plate discharge box 207 is mounted on the screen-printing apparatus 1 and the drive shaft 209*a* is in a rotational position other than the home position, as shown in FIG. 14(*b*), the engagement hole 212*a* and the coupling pin 210*a* engage each other to impart a prohibited state for prohibiting the removal of the plate discharge box 207 from the main body of the screen-printing apparatus 1 when an attempt is made to remove the plate discharge box 207 from the main body of the screen-printing apparatus 1.

Thus, the plate discharge box cover 212 and the coupling pin 210*a* comprise the lock mechanism 290 as a lock device for prohibiting the removal of the plate discharge box 207 from the main body of the screen-printing apparatus 1.

The control device 24 and the lock mechanism 290 as a lock setting device comprise the used-master security device that is capable of prohibiting the removal of used masters 34 inside the plate discharge box 207 and that prevents information recorded on the master 34 from being revealed.

The embodiments of the present invention, as described above with reference to the diagrams, involved a screen-printing apparatus 1 provided with a used-master security system to which the present invention has been applied, and with a used master security method for a printing apparatus in which the used-master security system for a printing apparatus is used. Printing apparatuses obtained using the present invention may have at least a used-master storage device and a least a portion of a used-master security device, a specific example of which is a lock device.

When the used master security device is provided with a control device, the lock device may be a mechanical device such as the above-described key cylinder, in which case the lock setting device may be a key or another tangible object. When a control device is provided, the used-master security system of the printing apparatus may be provided therewith, or the device may be provided separately from the printing apparatus.

In the description of the input/output devices provided to the screen-printing apparatus 1, a case was described in which the display apparatus 82 provided to the control panel 69 comprised the input/output device, but the input/output device may comprise the display apparatus 82 and a device provided with another control panel, or the input/output device may comprise a device provided with an control panel 69 other than the display apparatus 82.

The present invention can be applied to any type of printing apparatus that uses masters or the like, and can also be applied to printing apparatuses that are provided with a plurality of plate cylinders, and to other apparatuses that use a plurality of masters in a single printing process. Application of the present invention is not limited to the above-described embodiments as long as no particular limitations exist in the description provided above.

The present invention has the following characteristics as described above.

(1) The present invention is a used-master security system for a printing apparatus, comprising a used-master storage device provided to a printing apparatus main body and used for storing a used master, and a used-master security device that can prohibit the removal of a used-master inside the master storage device, so it is possible to provide a used-master security system for a printing apparatus that can prohibit the removal of used masters for any type of master, and to safely secure used masters by prohibiting the removal of used masters.

(2) The used-master security device comprises a lock device for prohibiting the removal of the used-master storage device from the main body of the printing apparatus, and a lock setting device for imparting a prohibited state to the lock device for prohibiting the removal of the used-master storage device from the main body of the printing apparatus, or a released state for permitting the removal of the used-master storage device from the main body of the printing apparatus, so it is possible to provide a used-master security system for a printing apparatus that is capable of selectively imparting a prohibited state and a released state to the lock mechanism with the lock setting device, prohibiting the removal of the used master without regard to the type of master, and safely securing the used master.

(3) The lock setting device is a control device for controlling the lock device and imparting a prohibited state or a released state, so it is possible to provide a used-master security system for a printing apparatus that is capable of relatively easily prohibiting the removal of used masters without regard to the type of master, and to more safely securing used masters by configuring the control device to selectively impart a prohibited state and a released state to the lock mechanism.

(4) The used-master storage device has a compression device for compressing used-masters, and at least a portion of the compression device comprises the lock device, so it is possible to provide a safe and inexpensive used-master security system for a printing apparatus that can simplify the structure of the lock device.

(5) A configuration is provided having a mount detection device for detecting whether the used-master storage device is mounted in the main body of the screen-printing apparatus, wherein the control device does not set the lock device in the prohibited state unless the mount detection device detects that the used-master storage device is mounted in the main body of the printing apparatus, so it is possible to provide a used-master security system for a printing apparatus that prevents the lock device from being set in the prohibited state despite the fact that the used-master storage device is not mounted in the main body of the printing apparatus, and that can prevent situations in which the used-master storage device cannot be mounted in the main body of the printing apparatus.

(6) The control device is set in a secure mode that allows the lock device to be set in the prohibited state, or in a non-secure mode for setting the lock device in the released state, and the lock device is not set in the prohibited state unless the control device is set in the secure mode so it is possible to provide a highly reliable, user-friendly used-master security system for a printing apparatus that prevents the lock device from being set in the prohibited state despite the fact that the system is in the non-secure mode.

(7) A configuration is provided having a mode input device capable of imparting the secure mode or the non-secure mode to the control device, so it is possible to provide a highly reliable, user-friendly used-master security system for a printing apparatus that sets the lock device in a state that allows the prohibited state to be set solely when required with the aid of the mode input device, and prevents the lock device from being set in the prohibited state despite the fact that the system is in the non-secure mode.

(8) A configuration is provided having a mode output device capable of outputting information about whether the system is in the secure mode or non-secure mode, so it is possible to provide a user-friendly used-master security system for a printing apparatus that allows the user to easily determine whether the system is in the secure mode or non-secure mode, and prevents operation in the non-secure mode despite the fact that the system is in the secure mode, and prevents operation in the secure mode despite the fact that the system in the non-secure mode.

(9) A configuration is provided having a removal detection device for detecting the removal of the used-master storage device, and a warning output device for outputting a warning when the removal detection device has detected that the used-master storage device has been removed, wherein the control device provides a warning to the warning output device when the removal detection device has detected the removal of the used-master storage device in the prohibited state, so it is possible to provide a used-master security system for a printing apparatus that can prohibit the inadvertent removal of used masters and to secure used masters with considerable level of safety by effectively preventing unauthorized removal of used masters.

(10) The warning output device is at least a warning sound output device for emitting a warning, or a warning display device for displaying a warning, so it is possible to provide a user-friendly used-master security system for a printing apparatus that can prevent the inadvertent removal of used masters, and can more safely secure used masters by warning with a method that easily calls a person's attention to effectively prevent unauthorized removal of used masters.

(11) A configuration is provided wherein the control device sets the lock mechanism in the prohibited state on at least one of the conditions that the power supply to the main body of the printing apparatus is OFF, and that the main body of the printing apparatus is in the power reduction standby mode, so it is possible to provide a used-master security system for a printing apparatus that can prohibit the removal of a used master, can prohibit the inadvertent removal of a used master, and can further safely secure used masters regardless of the condition of the printing apparatus.

(12) A configuration is provided having a master amount detection device for detecting the amount of used masters inside the used-master storage device, wherein the control device sets the lock device in the released state on the condition that the master amount detection device detects that the amount of used masters in the used-master storage device is a predetermined amount, so it is possible to provide a user-friendly used-master security system for a printing apparatus because, when the amount of used masters in the used-master storage device is full or nearly full, for example, the lock device is set in the released state, the used-master storage device is removed from the printing apparatus, and the used masters in the used master storage device can be discarded; and the lock device is set in a released state at other required times.

(13) By setting a predetermined amount as full, it is therefore possible to provide a user-friendly used-master security system for a printing apparatus because the lock device is set in a released state, and the used master storage device can be removed from the printing apparatus to discard the used masters in the used-master storage device when the amount of used masters has filled the used-master storage device, so the lock device is set in a released state when the used masters in the used-master storage device must be discarded.

(14) The master amount detection device has a "full" output device capable of outputting information indicating that the amount of used masters inside the used-master storage device is full when such a state has been detected, so it is possible to provide a very user-friendly used-master security system for a printing apparatus in which the user can easily verify that the amount of used masters in the used-master storage device is full and know that the used-master storage device should be removed from the printing apparatus and the used masters in the used-master storage device can be discarded, making the system particularly useful in cases in which the lock device is set in the released state when the used masters in the used-master storage device must be discarded.

(15) A configuration is provided having a "discard" output device capable of outputting information indicating that the used masters inside the used-master storage device should be discarded when the master amount detection device detects that the amount of used-masters in the used-master storage device is full and the control device has converted the state of the lock device from the prohibited state to the released state, so it is possible to provide a very user-friendly used-master security system for a printing apparatus in which it can easily be confirmed that the used-master storage device should be removed from the printing device to discard the used masters in the used-master storage device.

(16) A configuration is provided having a release input device for allowing the input to the control device to set the lock device in a released state when the control device has imparted a prohibited state to the lock device, wherein the control device sets the lock device in the released state on the condition that predetermined data is input thereto by the release input, so it is possible to provide a user-friendly and highly reliable used-master security system for a printing apparatus in which used masters can be easily and safely secured, and the used-master storage device can be removed from the printing apparatus and the used masters in the used-master storage device removed as required by allowing the removal of used masters to be prohibited with the aide of electronic data.

(17) A configuration is provided having a release data input device for allowing predetermined data to be rewritten, so it is possible to provide a user-friendly and highly reliable and safe used-master security system for a printing apparatus in which predetermined data can be rewritten as required.

(18) A configuration is provided having a jam detection device for detecting that a used master has jammed, wherein the control device sets the lock device in the released state on the condition that the jam detection device detects that a used master has jammed, so it is possible to provide a user-friendly, highly reliable used-master security system for a printing apparatus in which, when a jam has occurred and work is required to remove the used-master storage device from the printing apparatus to resolve the jam, the jam-resolving work can be easily carried out.

(19) The control device always sets the lock device in the released state when the jam detection device has detected that a used master has jammed, so it is possible to provide a more user-friendly, more highly reliable used-master security system for a printing apparatus in which, when a jam has occurred and work is required to remove the used-master storage device from the printing apparatus to resolve the jam, the jam-resolving work can be easily carried out.

(20) A setting can be established selectively such that the control device always sets or does not always set the lock device to the released state when jam detection device has detected that a used master has jammed, so it is possible to provide a more user-friendly, safe, and reliable used-master security system for a printing apparatus in which the service conditions of the printing apparatus are taken into consideration and in which it is possible to establish a setting whereby the lock device is always set to the released state when a used master has jammed.

(21) A device for inputting release setting during jamming is provided to allow a setting to be established so that the control device always sets the lock device to the released state when the jam detection device has detected that that a used master has jammed, so it is possible to provide a more user-friendly, safe, and reliable used-master security system for a printing apparatus in which the service conditions of the printing apparatus are taken into consideration and in which it is possible to establish a setting whereby the lock device is always set to the released state with relative ease when a used master has jammed.

(22) A jam output device is provided to make it possible to output information about a jammed master when a jam detection device has detected that a used master has jammed, so it is possible to provide a very user-friendly used-master security system for a printing apparatus in which the user can easily confirm the occurrence of a jam, and can determine that the used-master storage device must be removed from the printing apparatus to resolve the jam, making the system particularly useful in cases in which the lock device is set in the released state when a jam has occurred and the used-master storage device must be removed.

(23) A configuration is provided having a lock state output device capable of outputting information about whether the lock device is in the prohibited state or the released state, so it is possible to provide a user-friendly used-master security system for a printing apparatus in which the user can easily confirm whether the used master storage device can be removed, and can prevent inadvertent removal of the used-master storage device to avoid situations in which a warning is issued by the warning output device.

(24) The present invention is a used-master security method for a printing apparatus capable of prohibiting the removal of used masters from the used-master storage device with the use of the used-master security system for a printing apparatus, so it is possible to provide a printing apparatus that can prohibit the removal of used masters and to safely secure used masters without regard to the type of master by prohibiting the removal of used masters through the use of a used-master security system for a printing apparatus that has the effects described above.

(25) The present invention is a printing apparatus capable of prohibiting the removal of used masters from the used-master storage device, the apparatus having at least the used-master storage device and at least a portion of the used-master security device provided to the used-master security system for a printing apparatus, so it is possible to provide a printing apparatus that can prohibit the removal of used masters and to safely secure used masters without regard to the type of master through the use of a used-master security system for a printing apparatus that has the effects described above.

Various modifications will become possible for those skilled in the art after receiving the teachings of the present disclosure without departing from the scope thereof.

What is claimed is:

1. A used-master security system for a printing apparatus, comprising:

a used-master storage device provided to a printing apparatus main body and configured to store at least one used master, the used-master storage device including at least a front surface facing to an exterior of the printing apparatus and a rear surface opposite to the front surface and facing to an interior of the printing apparatus;

a mount detection device that detects whether the used-master storage device is mounted in the main body of the printing apparatus;

a used-master security device configured to prohibit the removal of a used-master inside the master storage device, the used-master security device including a locking mechanism secured to an interior of the printing apparatus;

a lock device; and a lock setting device that imparts to the lock device either a prohibited state for prohibiting the removal of the used-master storage device out from the main body of the printing apparatus, or a released state for permitting the removal of the used-master storage device out from the main body of the printing apparatus, wherein the lock setting device is a control device that controls the lock device and imparts to the lock device either a prohibited state or a released state, wherein the lock device includes a projection extending from the rear surface of the used-master storage device, the rear surface and projection facing the interior of the printing apparatus in an opposite direction from a direction of removal of the used-master storage device, wherein the projection is configured to project into an aperture formed in the locking mechanism, the locking mechanism configured to slide in a direction substantially perpendicular to the projection to engage the projection and prohibit the removal of the used-master storage device out from the main body of the printing apparatus, wherein the locking mechanism is located further to the interior of the printing apparatus than the rear surface of the used-master storage device, and wherein the control device does not set the lock device in the prohibited state unless the mount detection device detects that the used-master storage device is mounted in the main body of the printing apparatus.

2. The used-master security system for a printing apparatus as claimed in claim 1, wherein the used-master storage device has a compression device for compressing used-masters, and wherein at least a portion of the compression device comprises the lock device.

3. The used-master security system for a printing apparatus as claimed in claim 1, wherein the control device is set either in a secure mode that allows the lock device to be set in the prohibited state, or in a non-secure mode for setting the lock device in the released state, and the lock device is not set in the prohibited state unless the control device is set in the secure mode.

4. The used-master security system for a printing apparatus as claimed in claim 3, further comprising a mode input device capable of imparting either the secure mode or the non-secure mode to the control device.

5. The used-master security system for a printing apparatus as claimed in claim 3, further comprising a mode output device capable of outputting information about whether the system is in the secure mode or non-secure mode.

6. The used-master security system for a printing apparatus as claimed in claim 1, further comprising:

a removal detection device for detecting the removal of the used-master storage device; and a warning output device for outputting a warning when the removal detection device has detected that the used-master storage device has been removed, wherein the control device causes the warning output device to provide a warning when the removal detection device has detected the removal of the used-master storage device in the prohibited state.

7. The used-master security system for a printing apparatus as claimed in claim 6, wherein the warning output device is at least one of a warning sound output device for emitting a warning and a warning display device for displaying a warning.

8. The used-master security system for a printing apparatus as claimed in claim 1, wherein the control device sets the lock mechanism in the prohibited state on at least one of the conditions that the power supply to the main body of the printing apparatus is OFF, and that the main body of the printing apparatus is in a power reduction standby mode.

9. The used-master security system for a printing apparatus as claimed in claim 1, further comprising a master amount detection device for detecting an amount of used masters inside the used-master storage device, wherein the control device sets the lock device in the released state on the condition that the master amount detection device detects that the amount of used masters in the used-master storage device is a predetermined amount.

10. The used-master security system for a printing apparatus as claimed in claim 9, wherein the predetermined amount is a full amount.

11. The used-master security system for a printing apparatus as claimed in claim 10, wherein the master amount detection device has a "full" output device capable of outputting information indicating that the amount of used masters inside the used-master storage device is full when such a state has been detected.

12. The used-master security system for a printing apparatus as claimed in claim 10, further comprising a "discard" output device capable of outputting information indicating that the used masters inside the used-master storage device should be discarded when the master amount detection device detects that the amount of used-masters in the used-master storage device is full and the control device has converted the state of the lock device from the prohibited state to the released state.

13. The used-master security system for a printing apparatus as claimed in claim 1, further comprising a release input device for allowing the input to the control device to set the lock device in a released state when the control device has imparted a prohibited state to the lock device, wherein the control device sets the lock device in the released state on the condition that predetermined data is input thereto by the release input.

14. The used-master security system for a printing apparatus as claimed in claim 13, further comprising a release data input device for allowing the predetermined data to be rewritten.

15. The used-master security system for a printing apparatus as claimed in claim 1, further comprising a jam detection device for detecting that a used master has jammed, wherein the control device sets the lock device in the released state on the condition that the jam detection device detects that a used master has jammed.

16. The used-master security system for a printing apparatus as claimed in claim 15, wherein the control device always sets the lock device in the released state when the jam detection device has detected that a used master has jammed.

17. The used-master security system for a printing apparatus as claimed in claim 15, wherein a setting can be established selectively such that the control device always sets or does not always set the lock device to the released state when jam detection device has detected that a used master has jammed.

18. The used-master security system for a printing apparatus as claimed in claim 17, further comprising a device for inputting release setting during jamming to allow the setting to be established.

19. The used-master security system for a printing apparatus as claimed in claim 15, further comprising a jam output device capable of outputting information about a jammed master when a jam detection device has detected that a used master has jammed.

20. The used-master security system for a printing apparatus as claimed in claim 1, further comprising a lock state output device capable of outputting information about whether the lock device is in the prohibited state or the released state.

21. A used-master security method for a printing apparatus, comprising:

providing a used-master storage device to a printing apparatus main body for storing a used master, the used-master storage device including at least a front surface facing to an exterior of the printing apparatus and a rear surface opposite to the front surface and facing to an interior of the printing apparatus;

detecting whether the used-master storage device is mounted in the main body of the printing apparatus;

prohibiting the removal of a used-master inside the used-master storage device with a used-master security device, the used-master security device including a locking mechanism secured to an interior of the printing apparatus;

prohibiting the removal of the used-master storage device out from the main body of the printing apparatus using a lock device that includes a projection extending from the rear surface of the used-master storage device, the rear surface and projection facing the interior of the printing apparatus in an opposite direction from a direction of removal of the used-master storage device; and imparting to the lock device either a prohibited state for prohibiting the removal of the used-master storage device out from the main body of the printing apparatus, or a released state for permitting the removal of the used-master storage device out from the main body of the printing apparatus, wherein the projection is configured to project into an aperture formed in the locking mechanism, the locking mechanism is configured to slide in a direction substantially perpendicular to the projection to engage the projection and prohibit removal of the used-master storage device, wherein the locking mechanism is located further to the interior of the printing apparatus than the rear surface of the used-master storage device, and wherein the lock device is not set in the prohibited state unless used-master storage device is detected as being mounted in the main body of the printing apparatus.

22. A printing apparatus comprising:

at least a used-master storage device provided to a printing apparatus main body and used for storing a used master, the used-master storage device including at least a front surface facing to an exterior of the printing apparatus and a rear surface opposite to the front surface and facing to an interior of the printing apparatus;

a mount detection device that detects whether the used-master storage device is mounted in the main body of the printing apparatus;

at least a portion of a used-master security device provided to a used-master security system for the printing apparatus, said used-master security system configured to prohibit the removal of used masters inside the used-master storage device, wherein the used-master security system includes a locking mechanism secured to an interior of the printing apparatus;

a lock device; and a lock setting device that imparts to the lock device either a prohibited state for prohibiting the removal of the used-master storage device out from the main body of the printing apparatus, or a released state for permitting the removal of the used-master storage device out from the main body of the printing apparatus, wherein the lock setting device is a control device that controls the lock device and imparts to the lock device either a prohibited state or a released state, wherein the lock device includes a projection extending from the rear surface of the used-master storage device, the rear surface and projection facing the interior of the printing apparatus in an opposite direction from a direction of removal of the used-master storage device, wherein the projection is configured to project into an aperture formed in the locking mechanism, the locking mechanism configured to slide in a direction substantially perpendicular to the projection to engage the projection and prohibit the removal of the used-master storage device out from the main body of the printing apparatus, wherein the locking mechanism is located further to the interior of the printing apparatus than the rear surface of the used-master storage device, and wherein the control device does not set the lock device in the prohibited state unless the mount detection device detects that the used-master storage device is mounted in the main body of the printing apparatus.

* * * * *